US010377592B2

(12) United States Patent
Hama

(10) Patent No.: US 10,377,592 B2
(45) Date of Patent: Aug. 13, 2019

(54) SHEET LOADING APPARATUS AND IMAGE FORMING APPARATUS

(71) Applicant: Konica Minolta, Inc., Chiyoda-ku, Tokyo (JP)

(72) Inventor: Riichi Hama, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 16 days.

(21) Appl. No.: 15/614,972

(22) Filed: Jun. 6, 2017

(65) Prior Publication Data

US 2018/0022561 A1 Jan. 25, 2018

(30) Foreign Application Priority Data

Jun. 17, 2016 (JP) ..... 2016-120363
Jun. 17, 2016 (JP) ..... 2016-120364
Jun. 17, 2016 (JP) ..... 2016-120366

(51) Int. Cl.
*B65H 31/30* (2006.01)
*B65H 3/32* (2006.01)
(Continued)

(52) U.S. Cl.
CPC ..... *B65H 3/32* (2013.01); *B65H 3/66* (2013.01); *B65H 31/02* (2013.01); *B65H 31/3036* (2013.01); *B65H 31/3045* (2013.01); *B65H 31/3081* (2013.01); *G03G 15/6511* (2013.01); *G03G 15/6552* (2013.01); *G03G 15/6573* (2013.01); *B65H 2301/4212* (2013.01);
(Continued)

(58) Field of Classification Search
CPC ..... B65H 31/3036; B65H 31/3045; B65H 31/3081; B65H 2301/4224; B65H 2301/42242
See application file for complete search history.

(56) References Cited

U.S. PATENT DOCUMENTS 7,487,959 B2 * 2/2009 Noh ..... G03B 27/00 198/484.1
7,832,718 B2 * 11/2010 Fukasawa ..... B42C 1/125 270/58.07
(Continued)

FOREIGN PATENT DOCUMENTS

JP 2009-263028 A 11/2009
JP 2015-009962 1/2015
WO WO-2015022801 A1 * 2/2015 ..... B65H 31/3045

*Primary Examiner* — Luis A Gonzalez
(74) *Attorney, Agent, or Firm* — Squire Patton Boggs (US) LLP

(57) ABSTRACT

A sheet loading apparatus for carrying a sheet loaded in a first tray to a second tray includes: a grip portion configured to grip the sheet; a sliding portion configured to move the grip portion between a sheet gripping position and a sheet release position; a lift portion configured to move the grip portion and cause the grip portion to emerge from the sheet loading surface; and a common power transmission portion configured to transmit power to both the sliding portion and the lift portion, wherein in one cycle, after the sliding portion moves the grip portion to a downstream side, the lift portion moves the grip portion downward of the sheet loading surface to cause the grip portion to reach the release position, and after the sliding portion moves the grip portion to the upstream side, the lift portion moves the grip portion to the gripping position.

12 Claims, 11 Drawing Sheets

(51) Int. Cl.

| | |
|---|---|
| ***B65H 3/66*** | (2006.01) |
| ***G03G 15/00*** | (2006.01) |
| ***B65H 31/02*** | (2006.01) |

(52) U.S. Cl.

CPC ..... *B65H 2301/4213* (2013.01); *B65H 2301/4224* (2013.01); *B65H 2301/4478* (2013.01); *B65H 2301/44712* (2013.01); *B65H 2405/10* (2013.01); *B65H 2405/11151* (2013.01); *B65H 2405/52* (2013.01); *B65H 2405/581* (2013.01); *B65H 2405/5812* (2013.01); *B65H 2405/5831* (2013.01); *B65H 2405/5832* (2013.01); *B65H 2701/18262* (2013.01); *B65H 2701/18292* (2013.01); *B65H 2801/06* (2013.01); *B65H 2801/27* (2013.01)

(56) References Cited

U.S. PATENT DOCUMENTS

| | | | | |
|---|---|---|---|---|
| 7,992,856 | B2 * | 8/2011 | Saito ..... | B65H 31/3027 270/58.08 |
| 8,523,166 | B2 | 9/2013 | Jung | |
| 9,725,272 | B2 * | 8/2017 | Kimura ..... | B65H 31/3045 |
| 2009/0261522 | A1 | 10/2009 | Saito | |

* cited by examiner

SHEET LOADING APPARATUS AND IMAGE FORMING APPARATUS

The entire disclosures of Japanese Patent Application Nos. 2016-120363, 2016-120364, and 2016-120366, all filed on Jun. 17, 2016, including description, claims, drawings, and abstract are incorporated herein by reference in its entirety.

BACKGROUND OF THE INVENTION

Field of the Invention

The present invention relates to a sheet loading apparatus and an image forming apparatus including the sheet loading apparatus.

Description of the Related Art

In order to carry sheets such as printed paper in an orderly manner, an image forming apparatus such as a copier may include a sheet loading apparatus that carries and loads sheets in stages using a plurality of trays placed in line in a sheet feed direction. The sheet loading apparatus is used when, for example, a plurality of copies of the same document is printed in one print job, if it is desired to combine the sheets of each copy and discharge the copies. Examples of known technologies of such a sheet loading apparatus are disclosed in JP 2015-9962 A and JP 2009-263028 A.

A sheet loading apparatus described in JP 2015-9962 A is an apparatus that transports sheets on a loading surface of a first tray to load the sheets into a second tray. The sheet loading apparatus includes gripping means capable of gripping the sheets in the first tray, a rail member that supports the gripping means in such a manner as to be movable along a sheet feed direction and parallel to the sheet loading surface of the first tray, and a mechanism that oscillates the rail member perpendicularly to the sheet loading surface of the first tray. The sheet loading apparatus uses the rail member to move the gripping means gripping sheets at an upstream end of the first tray in the sheet feed direction to a downstream end in the sheet feed direction parallel to the sheet loading surface of the first tray. The sheet loading apparatus then moves, via the rail member, the gripping means downward perpendicularly to the sheet loading surface of the first tray, and uses the rail member to move the gripping means further to the upstream end in the sheet feed direction parallel to the sheet loading surface of the first tray. The sheet loading apparatus then moves, via the rail member, the gripping means upward perpendicularly to the sheet loading surface of the first tray to return the gripping means to a sheet gripping position. Consequently, the sheet loading apparatus can load the sheets in the first tray into the second tray in an orderly manner.

A sheet processing apparatus described in JP 2009-263028 A is an apparatus that carries a stack of sheets to a stack tray placed downstream of a processing tray. The sheet processing apparatus includes a sheet engagement member (gripper means) that engages with the stack of sheets in the processing tray, a carrier member where the sheet engagement member is mounted movably along a stack feed direction, and a loop guide groove that guides the movement of the carrier member. The loop guide groove is formed in a loop shape including an upper travel path and a lower travel path. The sheet processing apparatus uses the loop guide groove to move the sheet engagement member from a standby position to a stack carrying-out position along the upper travel path in the first leg of the travel, and moves the sheet engagement member from the stack carrying-out position to the standby position along the lower travel path in the return leg. Consequently, the sheet processing apparatus can carry a stack of sheets in the processing tray in an orderly manner to the stack tray.

A sheet discharge apparatus described in the specification of U.S. Pat. No. 8,523,166 includes a sheet gripping unit that grips a sheet, and a rail groove for guiding the sheet gripping unit movably along a sheet discharge direction. The rail groove is formed in a loop shape, including a path to move the sheet gripping unit along an upper surface of a tray from an upstream side to a downstream side in the sheet discharge direction, and a path to move the sheet gripping unit below the upper surface of the tray from the downstream side to the upstream side in the sheet discharge direction. The sheet discharge apparatus uses the rail groove to move the sheet gripping unit from a sheet gripping position along the upper path in the first leg of the travel, and to return the sheet gripping unit to the sheet gripping position along the lower path in the return leg.

However, if, for example, the sheet loading surface of the first tray is inclined, rising increasingly toward a downstream side in the sheet feed direction, in the sheet loading apparatus described in JP 2015-9962 A, when the gripping means is moved to the downstream end of the first tray in the sheet feed direction and then moved downward perpendicularly to the sheet loading surface, the gripping means protrudes further downstream of the downstream end of the first tray in the sheet feed direction. Consequently, the sheet loading apparatus may be increased in size, which is a problem.

Moreover, in the sheet loading apparatus described in JP 2015-9962 A, any portion of a slit with which the gripping means engages when moving along the rail member is formed with the same width and shape at the same angle in the sheet feed direction. Consequently, in order to move the gripping means upstream in the feed direction of a stack of sheets loaded in the first tray, it is necessary to secure a relatively large space for the movement of the gripping means in an upstream portion of the first tray in the sheet feed direction, which is a problem. If the space is relatively small, the gripping means may come into contact with an upstream end in the feed direction of the stack of sheets loaded in the first tray.

Moreover, in the sheet loading apparatus described in JP 2015-9962 A, when the gripping means descends at the downstream end of the first tray in the sheet feed direction, the upstream portion in the feed direction of the sheets gripped by the gripping means descends while staying parallel to the sheet loading surface of the first tray. Consequently, the buckling of the stack of sheets occurs, which is a problem. The occurrence of buckling on the sheets may result in making it impossible to carry the sheets in an orderly manner.

On the other hand, the sheet processing apparatus described in JP 2009-263028 A includes the loop guide groove. Accordingly, even if a sheet loading surface of the processing tray is inclined, rising increasingly toward the downstream side in the sheet feed direction, upsizing of the apparatus can be prevented. However, the sheet processing apparatus requires a drive source and drive mechanism of the sheet engagement member (gripper means), and a drive source and drive mechanism of the carrier member separately. An increase in the cost of the apparatus is a problem.

Moreover, in the sheet processing apparatus described in JP 2009-263028 A, when the sheet engagement member (gripper means) descends at an downstream end of the processing tray in a sheet feed direction, an upstream portion in the feed direction of the sheets gripped by the sheet engagement member is in an attitude facing downward. However, the sheets are released at a sheet release position in the state where the upstream portion of the sheet engagement member in the feed direction keeps facing downward. Accordingly, the sheets are messy at the time of release, which is a problem.

On the other hand, the sheet discharge apparatus described in the specification of U.S. Pat. No. 8,523,166 widens an area to grip the sheets by bringing the sheet gripping unit into contact with a boss portion of a housing, and also inclines the sheet gripping unit in the course of lifting the sheet gripping unit up toward a sheet loading surface when the sheet gripping unit is returned to a sheet gripping position along the lower path of the rail groove. The sheet gripping unit is inclined; accordingly, a space required on an upstream side of the tray in the sheet feed direction can be made relatively small. However, the sheet gripping unit is configured on the precondition that the sheet gripping unit is moved in the up-and-down direction. Therefore, the sheet gripping unit cannot be applied to a compact configuration that does not move in the up-and-down direction, which is a problem.

SUMMARY OF THE INVENTION

An object of the present invention is to provide a sheet loading apparatus and an image forming apparatus that solve at least one of the above problems.

To achieve the abovementioned object, according to an aspect, a sheet loading apparatus for carrying a sheet loaded in a first tray to a second tray downstream of the first tray in a sheet feed direction, reflecting one aspect of the present invention comprises: a grip portion configured to grip the sheet loaded in the first tray; a sliding portion configured to move the grip portion parallel to a sheet loading surface of the first tray between a sheet gripping position at an upstream end of the first tray in the sheet feed direction and a sheet release position at a downstream end in the sheet feed direction; a lift portion configured to move the grip portion via the sliding portion and cause the grip portion to emerge from the sheet loading surface of the first tray; and a common power transmission portion configured to transmit power to both the sliding portion and the lift portion, wherein in one cycle during which the grip portion is moved from the gripping position to the release position of a sheet and then back to the gripping position, after the sliding portion moves the grip portion from the gripping position of a sheet to a downstream side in the sheet feed direction, the lift portion moves the grip portion downward of the sheet loading surface of the first tray and in a direction in which the grip portion is inclined toward an upstream side in the sheet feed direction with respect to the sheet loading surface to cause the grip portion to reach the release position of a sheet, and after the sliding portion moves the grip portion concealed below the sheet loading surface of the first tray to the upstream side in the sheet feed direction, the lift portion moves the grip portion to the gripping position above the sheet loading surface of the first tray in a direction forming a substantially right angle to the sheet loading surface.

According to this configuration, the grip portion moves in the direction in which the grip portion is inclined with respect to the sheet loading surface of the first tray at the release position at the downstream end of the first tray in the sheet feed direction below the sheet loading surface and on the upstream side in the sheet feed direction. Consequently, if the sheet loading surface of the first tray is inclined, rising increasingly toward the downstream side in the sheet feed direction, when the grip portion is moved downward with respect to the sheet loading surface of the first tray at a downstream portion of the first tray in the sheet feed direction, the grip portion does not protrude further downstream with respect to the downstream end of the first tray in the sheet feed direction. Moreover, the common power transmission portion is included for both the sliding portion and the lift portion; accordingly, power is transmitted from the single drive source.

To achieve the abovementioned object, according to an aspect, a sheet loading apparatus for carrying a sheet loaded in a first tray to a second tray downstream of the first tray in a sheet feed direction, reflecting one aspect of the present invention comprises: a grip portion configured to grip the sheet loaded in the first tray; and a sliding portion configured to move the grip portion parallel to a sheet loading surface of the first tray between a sheet gripping position at an upstream end of the first tray in the sheet feed direction and a sheet release position at a downstream end in the sheet feed direction, wherein the sliding portion includes a plurality of engagement members supported by the grip portion and placed, side by side, in the sheet feed direction, a rail member having a guide portion extending parallel to the sheet loading surface of the first tray to movably engage with the plurality of engagement members along the sheet feed direction, and an expanded portion at an upstream end of the guide portion in the sheet feed direction, the expanded portion increasingly expanding the guide portion toward an upstream side in the sheet feed direction in a direction away from the sheet loading surface of the first tray.

According to this configuration, when the grip portion moves from a downstream portion to an upstream portion in the sheet feed direction, for example, the weight of the grip portion acts in a direction in which the plurality of engagement members is caused to follow one lower surface of the expanded portion. The grip portion is then inclined in such a manner that an area to grip a sheet faces upward. Consequently, when the grip portion moves to the sheet gripping position from below the sheet loading surface of the first tray, the grip portion moves to an upstream side of the sheet in the feed direction without coming into contact with an upstream end of the sheet in the feed direction. A space required to move the grip portion is relatively reduced in an upstream portion of the first tray in the sheet feed direction.

To achieve the abovementioned object, according to an aspect, a sheet loading apparatus for carrying a sheet loaded in a first tray to a second tray downstream of the first tray in a sheet feed direction, reflecting one aspect of the present invention comprises: a grip portion configured to grip the sheet loaded in the first tray; a sliding portion configured to move the grip portion parallel to a sheet loading surface of the first tray between a sheet gripping position at an upstream end of the first tray in the sheet feed direction and a sheet release position at a downstream end in the sheet feed direction; and a lift portion configured to move the grip portion via the sliding portion and cause the grip portion to emerge from the sheet loading surface of the first tray, wherein the sliding portion includes a plurality of engagement members supported by the grip portion and placed, side by side, in the sheet feed direction, and a rail member having a guide portion extending parallel to the sheet loading surface of the first tray to movably engage with the plurality of engagement members along the sheet feed direction, and the rail member includes a rotation guide member in a downstream portion in the sheet feed direction, including part of the guide portion and being supported at a downstream end rotatably about a support shaft extending in a direction intersecting with the sheet feed direction, a rotation guide biasing member configured to rotate the rotation guide member about the support shaft and bias the rotation guide member in a direction in which an upstream portion of the rotation guide member in the sheet feed direction comes close to the sheet loading surface of the first tray, a rotation stop portion configured to prevent the rotation guide member from being rotated and displaced from an attitude parallel to the sheet feed direction against biasing force of the rotation guide biasing member in a state where the rail member is closest to the sheet loading surface of the first tray, and a rotation return portion configured to rotate and displace the rotation guide member against the biasing force of the rotation guide biasing member to return the rotation guide member to the attitude parallel to the sheet feed direction in a state where the rail member is away from the sheet loading surface of the first tray and is close to the sheet release position.

According to this configuration, when the grip portion moves to the downstream end of the rail member in the sheet feed direction and the rail member moves away from the sheet loading surface of the first tray, the biasing force of the rotation guide biasing member inclines the grip portion in such a manner that an area to grip a sheet faces downward. Consequently, when a stack of sheets is loaded in the second tray, and the grip of the grip portion is released, the buckling of the stack is prevented. Furthermore, the attitude of the grip portion is returned to its original attitude at the sheet release position; accordingly, the sheets are released in the orderly state.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First Embodiment

Figure 1:
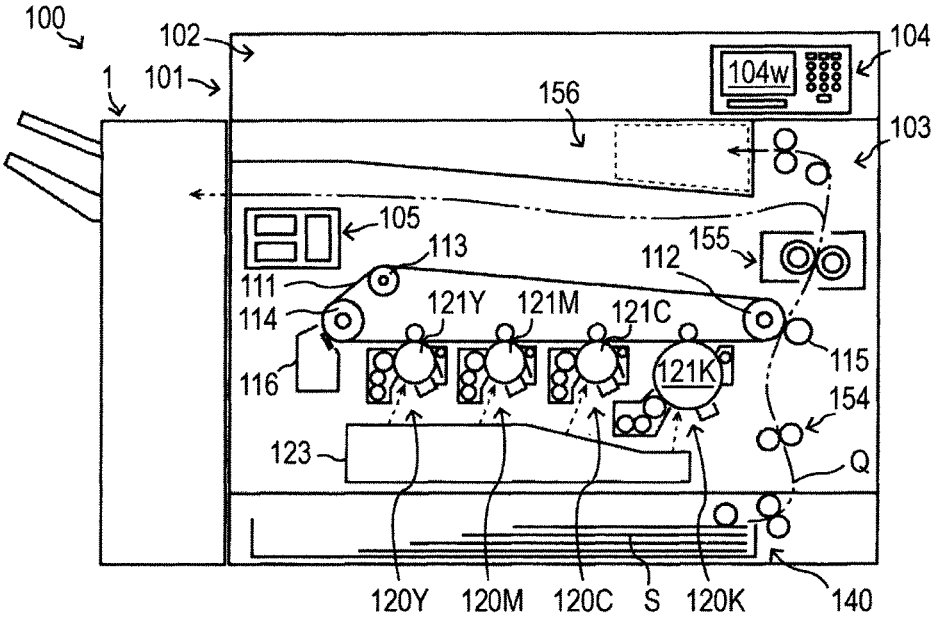
FIG. 1 is a partial vertical cross-sectional front view of an image forming apparatus according to an embodiment of the present invention.

Firstly, regarding an image forming apparatus according to an embodiment of the present invention, an image output operation, together with a schematic structure, is described with reference to FIG. 1. FIG. 1 is an example of a partial vertical cross-sectional front view of the image forming apparatus. Chain double dashed lines with an arrow in FIG. 1 indicate a sheet feed path and direction.

An image forming apparatus 100 is what is called a tandem color copier as shown in FIG. 1, and includes an image reading unit 102 that reads an image of a document, a printing unit 103 that prints the read image on a sheet such as paper, an operating unit 104 for inputting print conditions and displaying the operating status, and a main control unit 105.

The image reading unit 102 is publicly known which moves an unshown scanner to read an image of a document loaded on an upper surface of an unshown platen glass. The image of the document is separated into three colors, red (R), green (G), and blue (B), and converted by a unshown CCD (Charge Coupled Device) image sensor into an electrical signal. Consequently, the image reading unit 102 obtains image data of each color of red (R), green (G), and blue (B).

The main control unit 105 performs various processes on the image data of each color obtained by the image reading unit 102. The image data is converted into image data of reproduction colors of yellow (Y), magenta (M), cyan (C), and black (K), and stored in an unshown memory of the main control unit 105. The image data of each reproduction color stored in the memory is processed to correct a displacement, and then is read, scan line by scan line, in synchronization with the transport of a sheet to perform an optical scan on a photosensitive drum 121 being an image carrier.

The printing unit 103 forms an image by electrophotography, and transfers the image onto the sheet. The printing unit 103 includes an intermediate transfer belt 111 obtained by forming an intermediate transfer unit as an endless belt. The intermediate transfer belt 111 is wound around a drive roller 112, a tension roller 113, and a driven roller 114. The tension roller 113 is biased upward in FIG. 1 by an unshown spring to provide tension to the intermediate transfer belt 111. The drive roller 112 causes the intermediate transfer belt 111 to move and rotate counterclockwise in FIG. 1.

The drive roller 112 presses a secondary transfer roller 115 that the drive roller 112 faces across the intermediate transfer belt 111, and is in contact with the secondary transfer roller 115. In an area of the driven roller 114, an intermediate transfer cleaning unit 116 provided in such a manner as to face the driven roller 114 across the intermediate transfer belt 111 is in contact with an outer peripheral surface of the intermediate transfer belt 111. The intermediate transfer cleaning unit 116 removes and cleans attached substances such as tonner remaining on the outer peripheral surface of the intermediate transfer belt 111 after a tonner image formed on the outer peripheral surface of the intermediate transfer belt 111 is transferred onto a sheet S.

Image forming units 120Y, 120M, 120C, and 120K corresponding to the reproduction colors of yellow (Y), magenta (M), cyan (C), and black (K) are provided below the intermediate transfer belt 111. Unless required to be particularly restrictive, the identification symbols of "Y", "M", "C", and "K" may be omitted in the description, and collectively referred to as, for example, the "image forming unit 120." The four image forming units 120 are placed in a line along a rotation direction of the intermediate transfer belt 111 from an upstream side to a downstream side of the rotation direction. The configurations of the four image forming units 120 are all the same, and each include a charging unit, an exposure unit, a developing unit, a drum cleaning unit, and a primary transfer roller around the photosensitive drum 121 that rotates clockwise in FIG. 1.

An optical scanning device 123 being an exposure device is placed below the image forming unit 120. One optical scanning device 123 handles the four image forming units 120, and includes four unshown light sources such as semiconductor lasers corresponding respectively to the four photosensitive drums 121. The optical scanning device 123 modulates the four semiconductor lasers in accordance with image gradation data of the reproduction colors, and emits laser beams corresponding to the reproduction colors respectively to the four photosensitive drums 121.

A sheet loading apparatus 140 that loads a plurality of the sheets S such as paper and stores the sheets S therein is provided below the optical scanning device 123. The sheets S stored in the sheet loading apparatus 140 are sent to a sheet feed path Q, one at a time, sequentially from the top. The sheet S sent from the sheet loading apparatus 140 to the sheet feed path Q reaches an area of a resist roller pair 154. The resist roller pair 154 then sends the sheet S to a contact portion (secondary transfer nip portion) of the intermediate transfer belt 111 and the secondary transfer roller 115 in synchronization with the rotation of the intermediate transfer belt 111 while correcting sheet S feed skew (skew correction).

In the image forming unit 120, an electrostatic latent image is formed on the surface of the photosensitive drum 121 with the laser beam applied from the optical scanning device 123. The electrostatic latent image is visualized as a toner image by the developing unit. The toner image formed on the surface of the photosensitive drum 121 is primarily transferred onto the outer peripheral surface of the intermediate transfer belt 111 in a spot where the photosensitive drum 121 faces the primary transfer roller across the intermediate transfer belt 111. The toner images of the image forming units 120 are sequentially transferred onto the intermediate transfer belt 111 at predetermined timings with the rotation of the intermediate transfer belt 111. Accordingly, a color toner image created by superimposing toner images of the four colors, yellow, magenta, cyan, and black, is formed on the outer peripheral surface of the intermediate transfer belt 111.

The color toner image primarily transferred onto the outer peripheral surface of the intermediate transfer belt 111 is transferred onto the sheet S sent in synchronization by the resist roller pair 154 at a secondary transfer nip portion formed by the intermediate transfer belt 111 and the secondary transfer roller 115 coming into contact with each other.

Above the secondary transfer nip portion is a fixing unit 155. The sheet S onto which an unfixed toner image has been transferred at the secondary transfer nip portion is sent to the fixing unit 155 to be sandwiched between a heat roller and a pressure roller. The toner image is heated and pressurized to be fixed on the sheet S. The sheet S that has passed the fixing unit 155 is discharged onto a sheet discharge unit 156 provided above the intermediate transfer belt 111.

The operating unit 104 is provided on the front side of the image reading unit 102. The operating unit 104 accepts, for example, a user's inputs of settings of print conditions such as the kind, size, enlargement/reduction, and duplex printing or not of the sheet S to be used for printing, and inputs of settings such as a facsimile number and a sender's name in facsimile transmission. Moreover, the operating unit 104 displays, for example, the status of the apparatus, instructions, and error messages on a display unit 104*w* to act also as a notification unit that notifies the user of them.

Moreover, the main control unit 105 including an unshown CPU and image processing unit, and other unshown electronic components is provided to the image forming apparatus 100 to control the overall operation. The main control unit 105 uses the CPU being a central processing unit, and the image processing unit to control the components such as the image reading unit 102 and the printing unit 103 on the basis of a program and data that are stored and inputted in the memory, and achieve series of image forming operations and printing operations.

The image forming apparatus 100 includes a sheet loading apparatus 1. The sheet loading apparatus 1 is detachably connected to a main unit 101 on the left of the main unit 101 when viewing the image forming apparatus 100 from the front side in FIG. 1. The sheet S that has passed the fixing unit 155 reaches the sheet loading apparatus 1 via the feed path below the sheet discharge unit 156.

When, for example, a plurality of copies of the same document is printed in one print job, the sheet loading apparatus 1 can combine the sheets S, where the fixing of the toner image has been completed, of each copy and discharge the copies. Moreover, the sheet loading apparatus 1 can perform post-processing such as punching, stapling, and half-folding. The sheet loading apparatus can also be installed in a broken-line area of the sheet discharge unit 156 in FIG. 1 by limiting the functions of the sheet loading apparatus.

Figure 2:
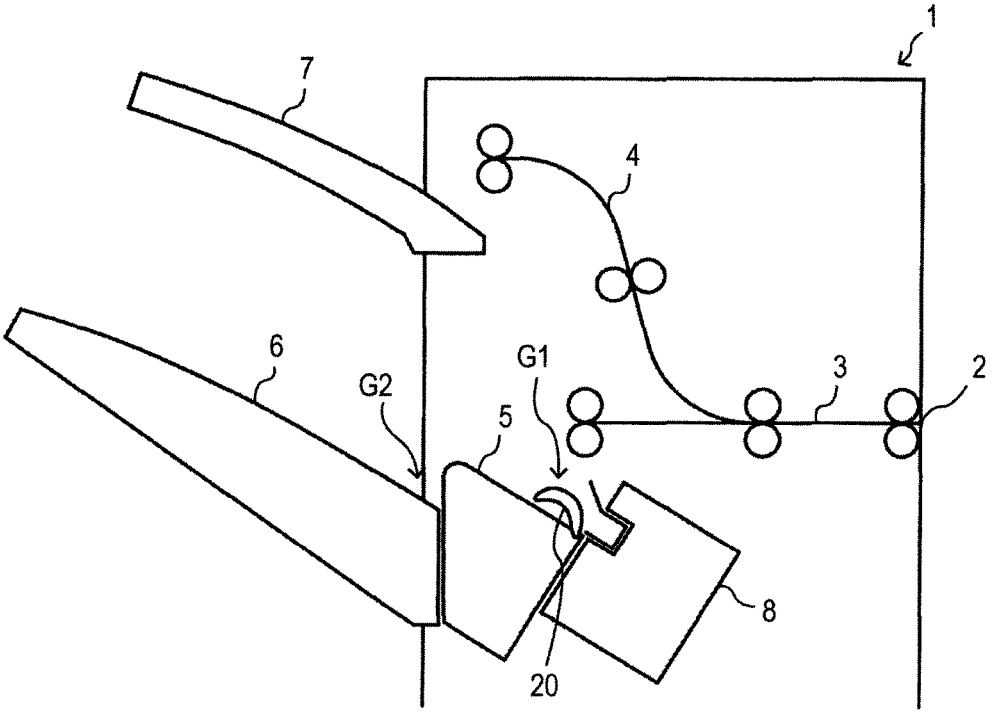
FIG. 2 is a schematic configuration diagram of a sheet loading apparatus according to the embodiment of the present invention.

Next, a schematic configuration of the sheet loading apparatus 1 of the image forming apparatus 100 is described with reference to FIG. 2. FIG. 2 is a schematic configuration diagram of the sheet loading apparatus.

As shown in FIG. 2, the sheet loading apparatus 1 includes a sheet inlet 2, a first sheet delivery path 3, a second sheet delivery path 4, an intermediate tray (first tray) 5, an output tray (second tray) 6, a sub tray 7, a post-processing device 8, and grip portions 20.

The sheet inlet 2 is provided in a side facing the main unit 101 of the image forming apparatus 100, and opens. The sheet S that has passed the fixing unit 155 is carried into the sheet loading apparatus 1 through the sheet inlet 2.

The first sheet delivery path 3 extends from the sheet inlet 2 to the intermediate tray 5. The second sheet delivery path 4 branches from the middle of the first sheet delivery path 3, and extends to the sub tray 7. The output tray 6 is provided downstream of the intermediate tray 5 in the sheet feed direction. The sub tray 7 is placed in the upper part of the sheet loading apparatus 1. The output tray 6 is placed below the sub tray 7.

A sheet loading surface of each of the intermediate tray 5, the output tray 6, and the sub tray 7 is inclined, rising increasingly toward the downstream side in the sheet feed direction. The user can takes out the sheet S discharged into the output tray 6 or sub tray 7.

The post-processing device 8 is placed upstream of the intermediate tray 5 in the sheet feed direction. The post-processing device 8 includes, for example, a stapling device. The sheet loading apparatus 1 uses the post-processing device 8 to perform post-processing such as stapling processing on a stack of the sheets S carried to the intermediate tray 5.

The grip portions 20 are provided to the intermediate tray 5. The sheet loading apparatus 1 grips the sheet S loaded in the intermediate tray 5, on which the post-processing has been performed, with the grip portions 20 to carry the sheet S to the output tray 6 provided downstream of the intermediate tray 5 in the sheet feed direction.

Figure 3:
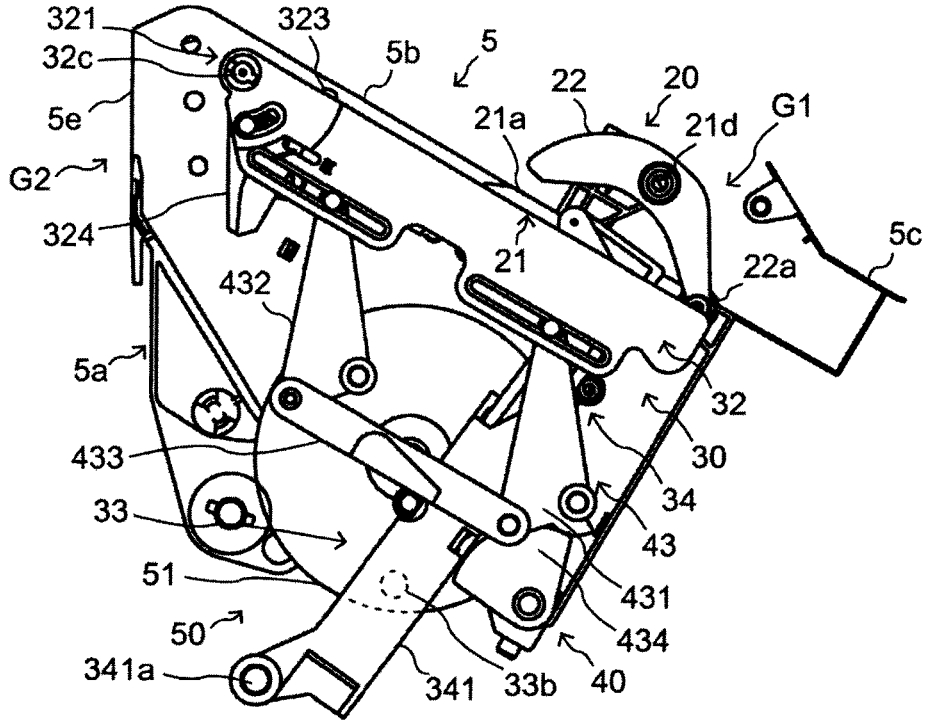
FIG. 3 is a front view showing the whole of an intermediate tray, a grip portion, and a drive unit of the grip portion of the sheet loading apparatus according to the embodiment of the present invention.
Figure 4:
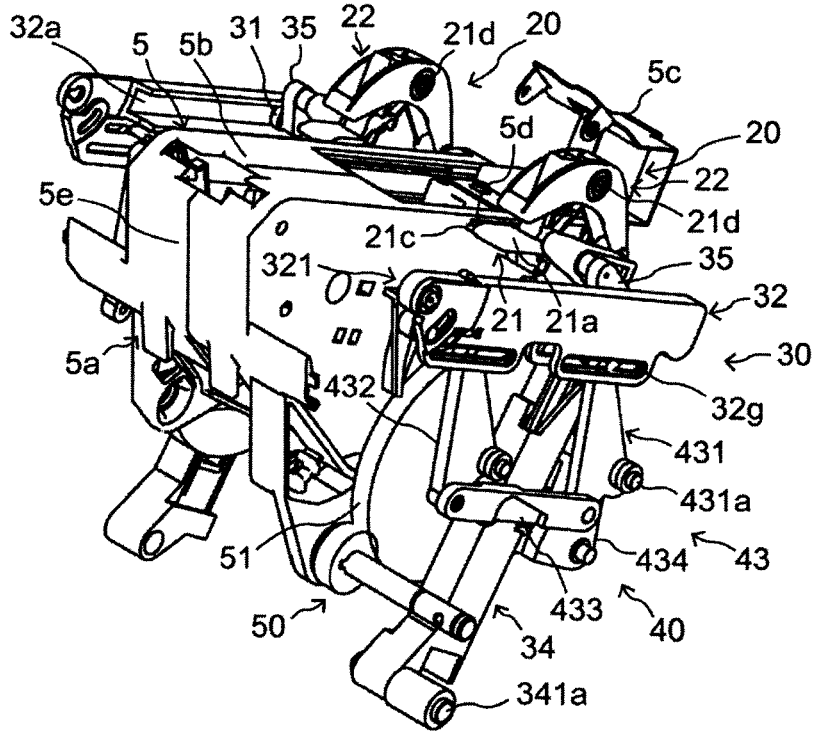
FIG. 4 is a perspective view showing the whole of the intermediate tray, the grip portion, and the drive unit of the grip portion of the sheet loading apparatus according to the embodiment of the present invention.
Figure 5:
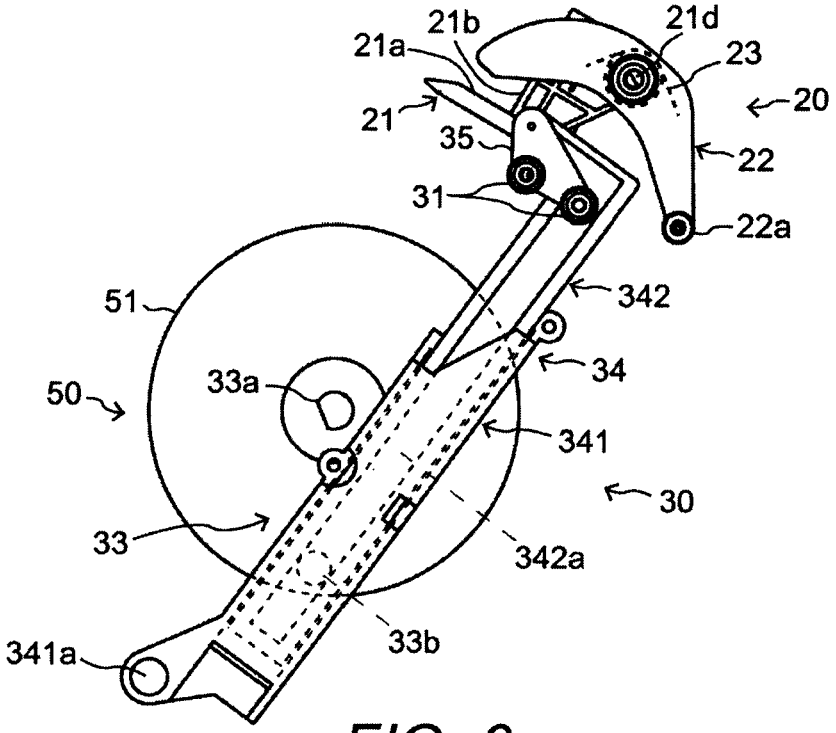
FIG. 5 is a front view of the grip portion, a sliding portion, and a power transmission portion of the sheet loading apparatus according to the embodiment of the present invention.
Figure 6:
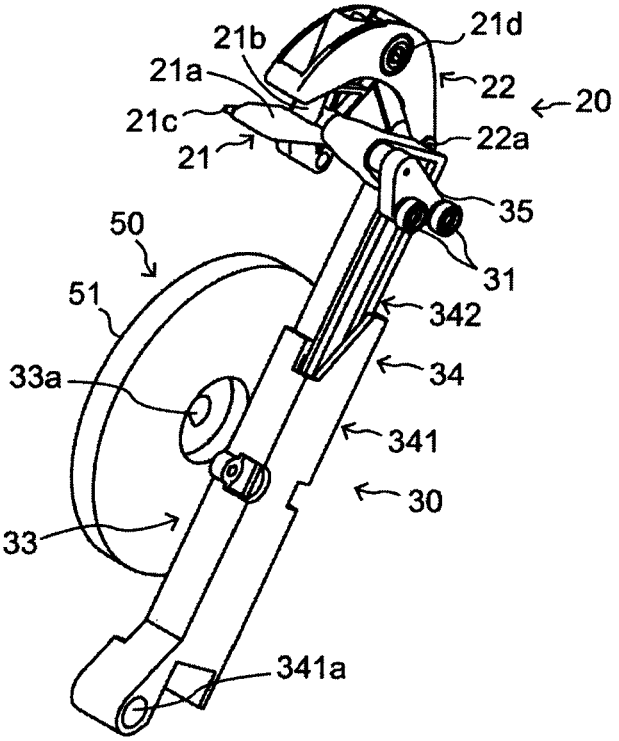
FIG. 6 is a perspective view of the grip portion, the sliding portion, and the power transmission portion of the sheet loading apparatus according to the embodiment of the present invention.
Figure 7:
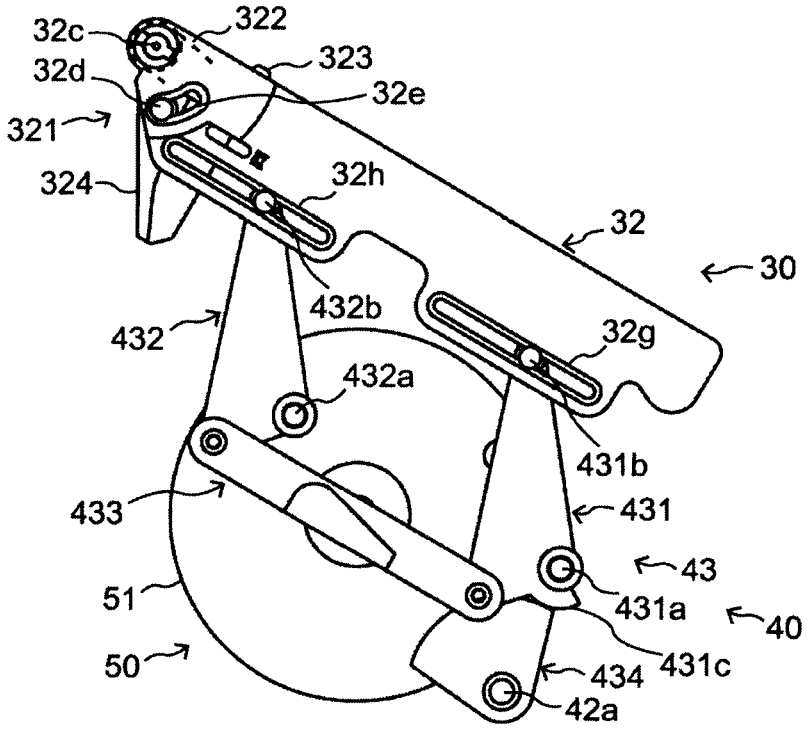
FIG. 7 is a front view of the sliding portion, a lift portion, and the power transmission portion of the sheet loading apparatus according to the embodiment of the present invention.
Figure 8:
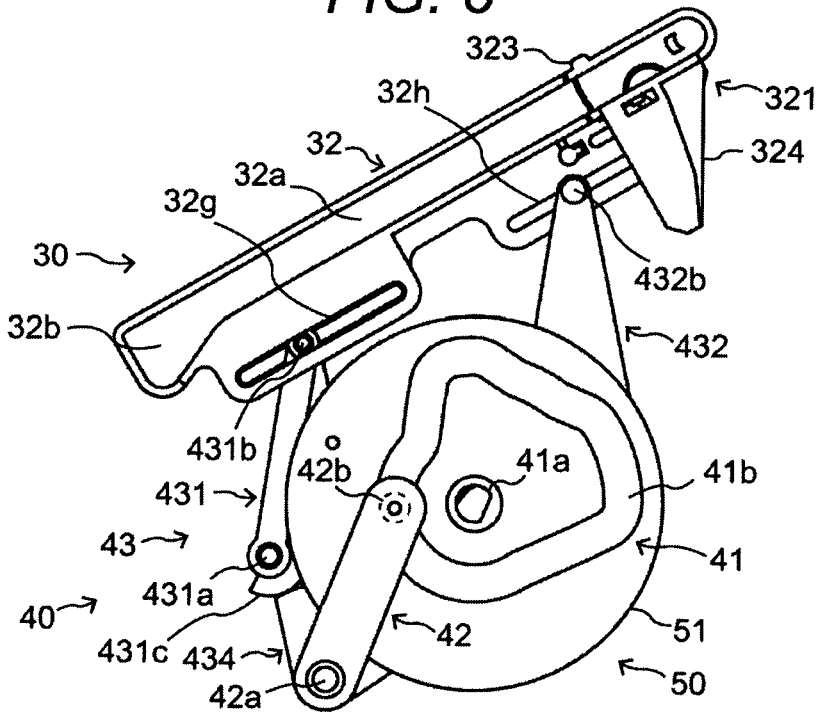
FIG. 8 is a rear view of the sliding portion, the lift portion, and the power transmission portion of the sheet loading apparatus according to the embodiment of the present invention.
Figure 9:
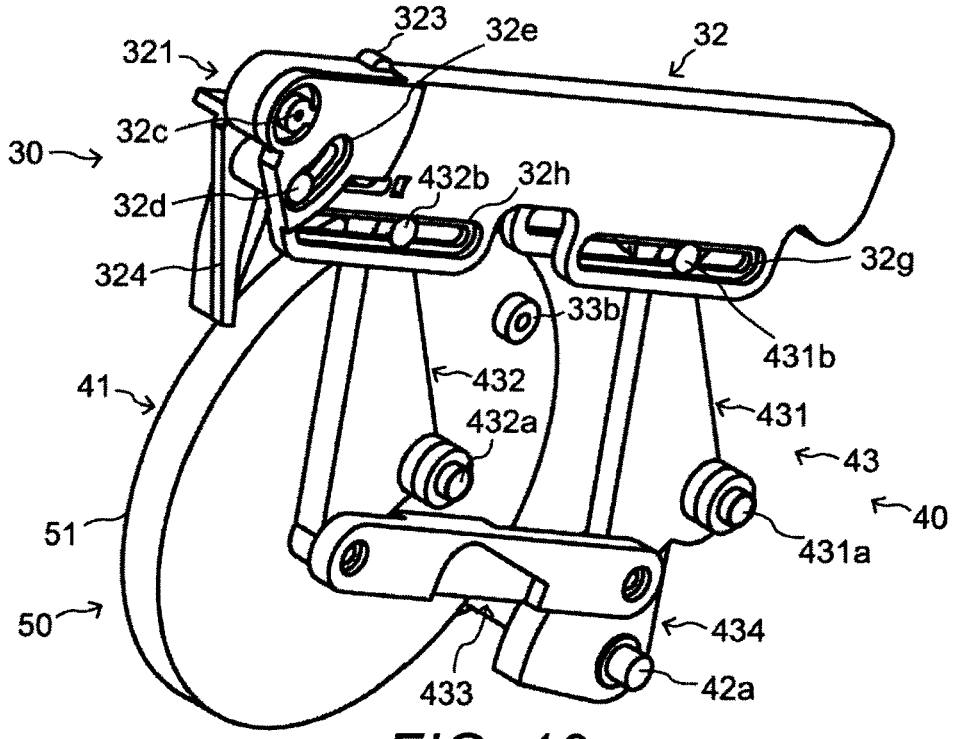
FIG. 9 is a perspective view of the sliding portion, the lift portion, and the power transmission portion of the sheet loading apparatus according to the embodiment of the present invention when viewed from the front.
Figure 10:
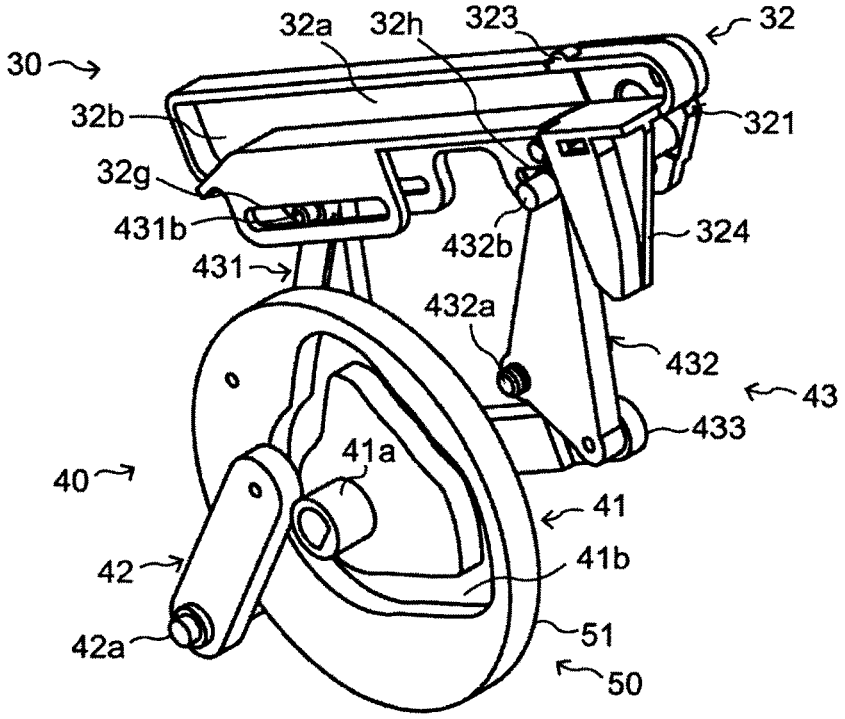
FIG. 10 is a perspective view of the sliding portion, the lift portion, and the power transmission portion of the sheet loading apparatus according to the embodiment of the present invention when viewed from the rear.

Next, detailed configurations of the intermediate tray 5, the grip portion 20, and a drive unit of the grip portion 20 of the sheet loading apparatus 1 are described with reference to FIGS. 3 to 10. FIGS. 3 and 4 are a front view and a perspective view showing the whole of the intermediate tray 5, the grip portion 20, and the drive unit of the grip portion 20. FIGS. 5 and 6 are a front view and a perspective view of the grip portion 20, a sliding portion, and a power transmission portion. FIGS. 7 and 8 are a front view and a perspective view of the sliding portion, a lift portion, and the power transmission portion. FIGS. 9 and 10 are a perspective view of the sliding portion, the lift portion, and the power transmission portion when viewed from the front, and a perspective view of them when viewed from the rear.

The intermediate tray 5 includes a sheet loading surface 5*b* on an upper surface of a housing portion 5*a* thereof. The sheet loading surface 5*b* is inclined, rising increasingly toward the downstream side in the sheet feed direction as described above. In other words, the intermediate tray 5 is configured in such a manner as to be inclined to locate a gripping position G1 of the sheet S of the sheet loading surface 5*b* below a release position G2 of the sheet S. Moreover, the intermediate tray 5 includes a sheet trailing end member 5*c* in the center in the sheet width direction that intersects with the sheet feed direction. The sheet trailing end member 5*c* receives the sheet S that falls freely from the first sheet delivery path 3, and moves the sheet S to the gripping position G1.

The intermediate tray 5 includes sliding portions 30, lift portions 40, and power transmission portions 50, each of which is the drive unit of the grip portion 20 illustrated in FIGS. 3 and 4, in addition to the grip portion 20.

A pair of the grip portions 20 has the same configuration, and is placed, side by side, in the sheet width direction across the intermediate tray 5. When the sheet S is carried from the intermediate tray 5 to the output tray 6, the grip portions 20 appear above the sheet loading surface 5*b* of the intermediate tray 5. The grip portion 20 includes a lower grip 21, an upper grip 22, and a grip biasing member 23, which are illustrated in FIGS. 5 and 6.

The lower grip 21 is formed in the lower part of the grip portion 20, and includes a gripping surface 21*a* facing the undersurface of the sheet S. The gripping surface 21*a* comes into contact with the sheet S from below. Moreover, the lower grip 21 includes a wall portion 21*b* extending upward at a right angle to the gripping surface 21*a*. The wall portion 21*b* comes into contact with the sheet S from the upstream side in the sheet feed direction.

Moreover, the lower grip 21 includes a retaining piece 21*c* on the intermediate tray 5 side of the gripping surface 21*a*. On the other hand, the intermediate tray 5 includes a retaining plate 5*d* below the sheet loading surface 5*b* at the gripping positon G1 of the sheet S and above the retaining piece 21*c*. The retaining piece 21*c* comes into contact with the undersurface of the retaining plate 5*d* when the grip portion 20 rises toward the gripping position G1 of the sheet S in an upstream portion of the intermediate tray 5 in the sheet feed direction. Consequently, the gripping surface 21*a* of the lower grip 21 is configured in such a manner as to be prevented from being displaced upward of the sheet loading surface 5*b* at the gripping position G1 of the sheet S.

The upper grip 22 is placed in the upper part of the grip portion 20. The upper grip 22 has a substantially crescent shape whose upstream and downstream ends in the sheet feed direction are curved downward when viewed from the sheet width direction, as shown in FIG. 5. The downstream end of the upper grip 22 in the sheet feed direction comes into contact with the sheet S from above.

The lower grip 21 includes a connecting shaft 21*d* extending in the sheet width direction in an area in the wall portion 21*b*, the area corresponding to substantially the center of the upper grip 22 in the sheet feed direction. The upper grip 22 is rotatably connected to the lower grip 21 via the connecting shaft 21*d*.

The grip biasing member 23 is provided in an area of the connecting shaft 21*d*. The grip biasing member 23 includes, for example, a helical torsion spring, and rotates the upper grip 22 about the connecting shaft 21*d* to bias the upper grip 22 in a direction in which a downstream portion of the upper grip 22 in the sheet feed direction comes close to the gripping surface 21*a* of the lower grip 21.

The upstream end of the upper grip 22 in the sheet feed direction is provided with a contact portion 22*a* for the housing portion 5*a* of the intermediate tray 5. The contact portion 22*a* comes into contact with the housing portion 5*a* when the grip portion 20 moves to the most upstream side of the intermediate tray 5 in the sheet feed direction. Consequently, the downstream portion of the upper grip 22 in the sheet feed direction rotates the upper grip 22 about the connecting shaft 21*d* and displaces the upper grip 22 against the biasing force of the grip biasing member 23 in a direction away from the gripping surface 21*a* of the lower grip 21 (see FIG. 11). As a result, when the sheet S is gripped, the space between the lower grip 21 and the upper grip 22 of the grip portion 20 is fully extended.

The sliding portions 30 are provided respectively to the grip portions 20 of the pair. The sliding portion 30 is placed substantially below the grip portion 20. The sliding portion 30 includes rollers 31, a rail member 32, a crank portion 33, and a crank arm 34, which are illustrated in FIGS. 3 to 10.

The rollers 31 are placed outward of the grip portion 20 with respect to the center of the intermediate tray 5 in the sheet width direction. The roller 31 is rotatably supported by a support shaft provided to a support member 35 attached outward of the lower grip 21 in the sheet width direction, the support shaft extending in the sheet width direction. Two rollers 31 are placed, side by side, along the sheet feed direction and parallel to the gripping surface 21*a* of the lower grip 21.

The rail member 32 is placed outward of the grip portion 20 with respect to the center of the intermediate tray 5 in the sheet width direction. The rail member 32 includes a guide portion 32*a* extending parallel to the sheet loading surface 5*b* of the intermediate tray 5.

The guide portion 32*a* is formed in a gutter shape recessed from the inner side (the intermediate tray 5 side) in the sheet width direction to the outer side in the sheet width direction, the gutter shape extending parallel to the sheet loading surface 5*b*. The two rollers 31 supported by the grip portion 20 are inserted in the guide portion 32*a*. The roller 31 is an engagement member that movably engages with the guide portion 32*a* along the sheet feed direction. Most of the guide portion 32*a* including an area from the center to the downstream portion in the sheet feed direction has some width that has no backlash with respect to the outside diameter of the roller 31. Consequently, the roller 31 can move smoothly in the guide portion 32*a*.

The guide portion 32*a* includes an expanded portion 32*b* provided at an upstream end thereof in the sheet feed direction (see FIG. 8). In the expanded portion 32*b*, the guide portion 32*a* increasingly expands toward the upstream side in the sheet feed direction in a direction away from the sheet loading surface 5*b* of the intermediate tray 5, that is, downward. In the expanded portion 32*b*, the roller 31 can move in an up-and-down direction that intersects with the sheet feed direction being the direction in which the guide portion 32*a* extends.

Moreover, the rail member 32 includes a rotation guide member 321, a rotation guide biasing member 322, and a rotation stop portion 323.

The rotation guide member 321 is provided to a downstream portion of the rail member 32 in the sheet feed direction, and includes part of the guide portion 32*a*. In other words, the downstream portion and downstream end of the guide portion 32*a* in the sheet feed direction are formed as the rotation guide member 321. The rotation guide member 321 is supported at the downstream end of the rail member 32 in the sheet width direction, rotatably about a support shaft 32*c* extending in the sheet width direction. The rotation guide member 321 is rotated and displaced relatively to a main portion of the rail member 32.

The rotation guide member 321 includes a projection 32*d* on the outer side in the radial direction than the support shaft 32*c*, the projection 32*d* protruding outward in the sheet width direction with respect to the center of the intermediate tray 5 in the sheet width direction. On the other hand, the rail member 32 includes a restriction groove 32*e* that is curved in an arc shape in the circumferential direction with the axis of the support shaft 32*c* as the center and that penetrates along the sheet width direction, in an area corresponding to the projection 32*d*. The projection 32*d* is inserted in the restriction groove 32*e* to engage with the restriction groove 32*e*. The restriction groove 32*e* restricts the rotatable range of the projection 32*d*, that is, the rotatable range of the rotation guide member 321.

The rotation guide biasing member 322 is provided in the location of the support shaft 32*c*. The rotation guide biasing member 322 includes, for example, a helical torsion spring, and rotates the rotation guide member 321 about the support shaft 32*c* to bias the rotation guide member 321 in a direction in which the upstream portion of the rotation guide member 321 in the sheet feed direction comes close to the sheet loading surface 5*b* of the intermediate tray 5.

The rotation stop portion 323 is provided, at the downstream end in the rotation direction of the rotation guide member 321 biased by the rotation guide biasing member 322, on an upper surface of the rotation guide member 321. The rotation stop portion 323 comes into contact with the housing portion 5*a* of the intermediate tray 5 when the rail member 32 comes closest to the sheet loading surface 5*b* of the intermediate tray 5. Consequently, the rotation stop portion 323 prevents the rotation guide member 321 from being rotated and displaced from the attitude parallel to the sheet feed direction against the biasing force of the rotation guide biasing member 322. In other words, when the rail member 32 is closest to the sheet loading surface 5*b* of the intermediate tray 5, the guide portion 32*a* extends straight from the upstream portion thereof in the sheet feed direction to the downstream end in the sheet feed direction provided to the rotation guide member 321, and the rollers 31 can move straight from the upstream end to the downstream end of the guide portion 32*a* in the sheet feed direction.

The rotation guide member 321 includes an engagement piece 324 being a rotation return portion in the lower part thereof. The engagement piece 324 comes into contact with the lift portion 40 when the rail member 32 moves downward, a predetermined distance away from the sheet loading surface 5*b*, and comes close to a release position G2 of the sheet S. Consequently, when the rail member 32 is below the sheet loading surface 5*b*, the rotation guide member 321 is rotated and displaced against the biasing force of the rotation guide biasing member 322 to return the guide portion 32*a* to the form extending straight from the upstream portion to the downstream end in the sheet feed direction.

The crank portion 33 is provided below the sheet loading surface 5*b* of the intermediate tray 5. The crank portion 33 includes a crank shaft 33*a* and a crankpin 33*b*. The crank shaft 33*a* extends in the sheet width direction and is rotatably supported by the housing portion 5*a* of the intermediate tray 5. The crank pin 33*b* extends parallel to the crank shaft 33*a* and outward away in the radial direction from the crank shaft 33*a*.

The crank portion 33 is formed on a disc member 51 being a rotator of the power transmission portion 50. The disc member 51 is placed in such a manner that its plane of rotation extends in the sheet feed direction and the up-and-down direction. The crank portion 33 can be rotated about the crank shaft 33*a* in a plane extending in the sheet feed direction and the up-and-down direction.

The crank arm 34 is placed outward of the crank portion 33 with respect to the center of the intermediate tray 5 in the sheet width direction. The crank arm 34 is formed in an oblong shape extending in the substantially up-and-down direction, and includes a first arm member 341 and a second arm member 342.

The first arm member 341 is provided in the lower part of the crank arm 34. The first arm member 341 is rotatably supported at the lower end by the housing portion 5*a* via a support shaft 341*a* parallel to the crank shaft 33*a*. The first arm member 341 is formed in a rectangular cylinder shape whose cross-section is of a rectangular shape. The second arm member 342 is inserted into the first arm member 341 from an opening at the upper end opposite to the lower end provided with the support shaft 341*a* to be fitted therein.

The second arm member 342 is provided in the upper part of the crank arm 34. The lower part of the second arm member 342 is inserted into the first arm member 341. The second arm member 342 can be displaced relatively to the first arm member 341. The grip portion 20 is attached to the upper end of the second arm member 342 in such a manner as to be rotatable about the axis extending in the sheet width direction.

The second arm member 342 extends in its longitudinal direction, and includes a groove portion 342*a* recessed in the sheet width direction. The groove portion 342*a* has a width that allows the crank pin 33*b* to be inserted into it. The crank pin 33*b* engages with the groove portion 342*a* in such a manner as to be movable along the longitudinal direction of the crank arm 34.

The lift portions 40 are provided respectively to the grip portions 20 of the pair as in the sliding portions 30. The lift portion 40 is placed substantially below the grip portion 20. The lift portion 40 includes a cam portion 41, a follower member 42, and a link mechanism 43, which are illustrated in FIGS. 3, 4 and 7 to 10.

The cam portion 41 is provided below the sheet loading surface 5*b* of the intermediate tray 5. The cam portion 41 includes a camshaft 41*a* and a cam groove 41*b*. The camshaft 41*a* extends in the sheet width direction, and is rotatably supported by the housing portion 5*a* of the intermediate tray 5. The cam groove 41*b* is formed in a ring shape surrounding the axis of the cam shaft 41*a* outward in the radial direction from the axis.

The cam portion 41 is formed on the disc member 51 of the power transmission portion 50. The cam groove 41*b* is formed on one flat surface opposite to the other flat surface on which the crank pin 33*b* is formed, of the disc member 51. The cam portion 41 can be rotated about the cam shaft 41*a* in a plane extending in the sheet feed direction and the up-and-down direction.

The follower member 42 is placed adjacent in the sheet width direction to the cam portion 41. The follower member 42 is formed in an oblong shape. One end of the follower member 42 is rotatably supported at one end by the housing portion 5*a* via a support shaft 42*a* parallel to the cam shaft 41*a*. The support shaft 42*a* is provided on the outer side in the radial direction than the disc member 51. The follower member 42 is provided at the other end with a follower portion 42*b*. The follower portion 42*b* protrudes toward the cam groove 41*b* in the sheet width direction, and is inserted into the cam groove 41*b*. The follower member 42 can oscillate about the axis of the support shaft 42*a*, following the shape of the cam groove 41*b*.

The link mechanism 43 is placed below the rail member 32 and connected between the rail member 32 and the follower member 42. The link mechanism 43 includes a first link member 431, a second link member 432, a connecting link 433, and an interlocking gear 434.

The first link member 431 and the second link member 432 have substantially the same shape, and are placed, side by side, in the sheet width direction of the intermediate tray 5. The first link member 431 and the second link member 432 are rotatably supported by the housing portion 5*a*, respectively, via support shafts 431*a* and 432*a* provided at lower positions parallel to the sheet feed direction, the support shafts 431*a* and 432*a* extending in the sheet width direction.

Moreover, the first link member 431 and the second link member 432 include, at the upper end, engagement pins 431*b* and 432*b*, respectively. On the other hand, the rail member 32 includes two slits 32*g* and 32*h* below the guide portion 32*a*. The two slits 32*g* and 32*h* extend parallel to the sheet feed direction of the intermediate tray 5, and are placed, side by side, parallel to the sheet feed direction. The engagement pin 431*b* of the first link member 431 is inserted into the slit 32*g* placed in the upstream portion of the rail member 32 in the sheet feed direction to engage with the slit 32*g*. The engagement pin 421*b* of the second link member 432 is inserted into the slit 32*h* placed in the downstream portion of the rail member 32 in the sheet feed direction to engage with the slit 32*h*.

The connecting link 433 is placed in the lower parts of the first link member 431 and the second link member 432 and between the first link member 431 and the second link member 432. The connecting link 433 connects the first link member 431 and the second link member 432.

The interlocking gear 434 is placed below the first link member 431. The interlocking gear 434 is connected at the center of rotation to the support shaft 42*a* of the follower member 42. In other words, the interlocking gear 434 can be rotated about the axis of the support shaft 42*a* with the oscillation of the follower member 42. The interlocking gear 434 engages with a gear portion 431*c* provided below the support shaft 431*a* of the first link member 431.

In terms of the link mechanism 43, the oscillation of the follower member 42 is transmitted to the first link member 431 via the interlocking gear 434 to allow the second link member 432 to perform the same operation as the first link member 431 via the connecting link 433. As a result, the link mechanism 43 moves the rail member 32, that is, the sliding portion 30 in the up-and-down direction in step with the oscillation of the follower member 42.

The power transmission portion 50 is placed in the lower parts of the sliding portion 30 and the lift portion 40. The power transmission portion 50 includes the disc member 51 being a single rotator. The disc member 51 is placed in such a manner that the plane of rotation extends in the sheet feed direction and the up-and-down direction as described above. The crank portion 33 is formed in one plane of rotation of the disc member 51, and the cam portion 41 in the other plane of rotation.

The crank shaft 33*a* is formed in the center axis portion of the disc member 51. The crank pin 33*b* is formed in one plane of rotation of the disc member 51, and protrudes outward in the sheet width direction from this plane of rotation. The crank portion 33 can be rotated about the crank shaft 33*a* in the plane extending in the sheet feed direction and the up-and-down direction.

The cam shaft 41*a* is formed in the center axis portion of the disc member 51. The cam groove 41*b* is formed in the other plane of rotation of the disc member 51 and is configured in such a manner as to be of a gutter shape recessed inward in the sheet width direction from this plane of rotation. The cam portion 41 can be rotated about the cam shaft 41*a* in the plane extending in the sheet width direction and the up-and-down direction.

In this manner, the crank portion 33 and the cam portion 41 are formed on the disc member 51. The rotation axis of the disc member 51 agrees with the axes of the crank shaft 33*a* and the cam shaft 41*a*. The common power transmission portion 50 transmits power to both the sliding portion 30 and the lift portion 40.

Figure 11:
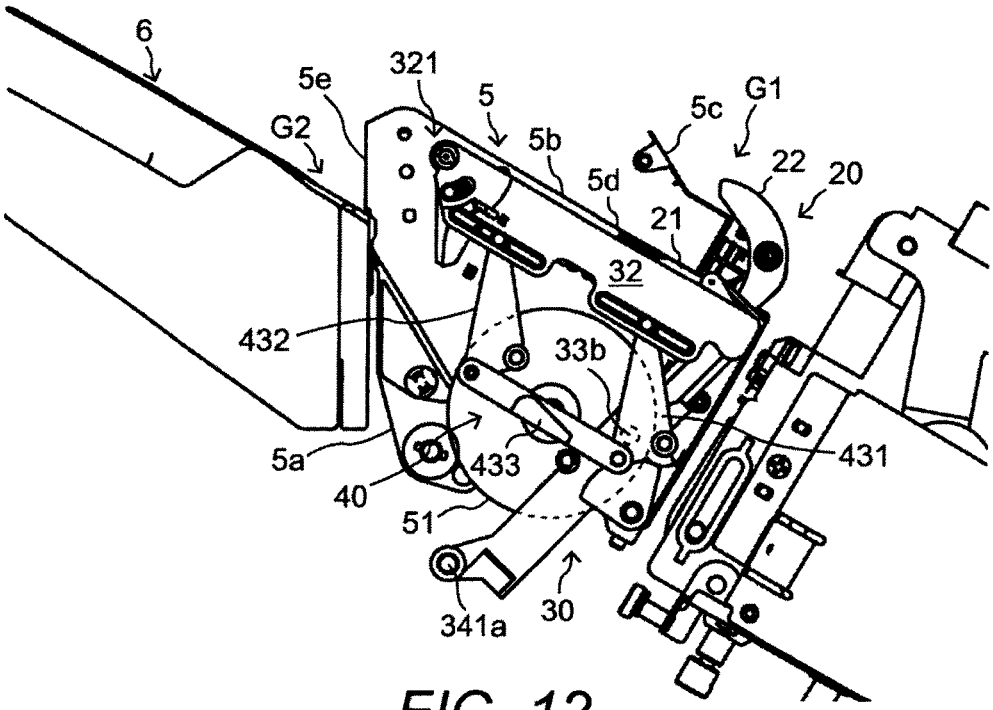
FIG. 11 is front view of the sheet loading apparatus according to the embodiment of the present invention, showing a state where the grip portion is at a sheet gripping position.
Figure 12:
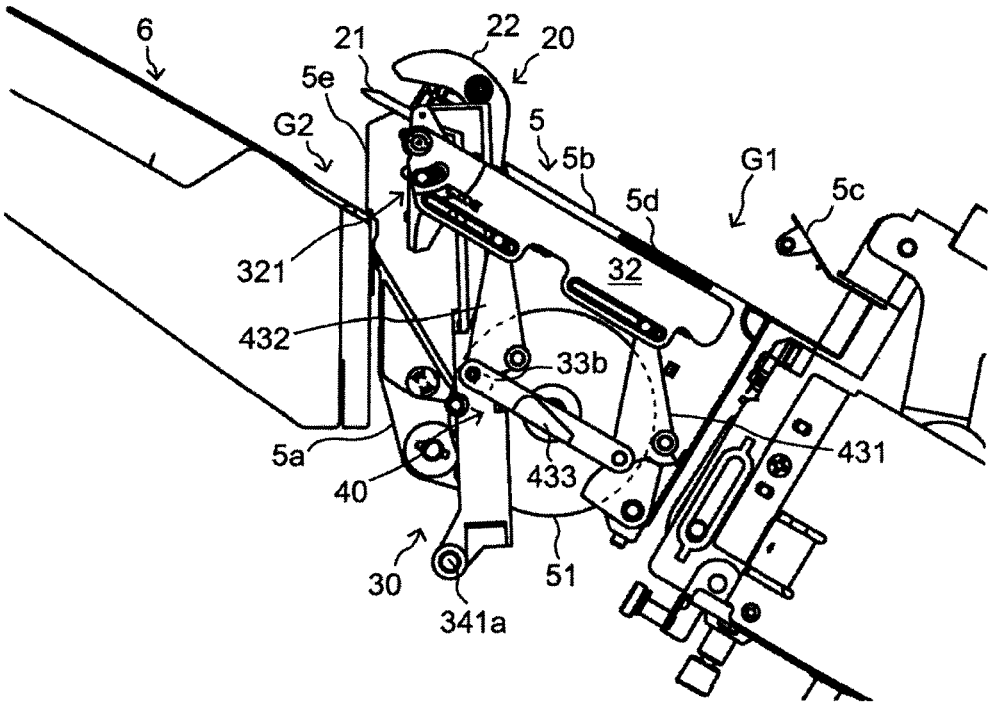
FIG. 12 is a front view of the sheet loading apparatus according to the embodiment of the present invention, showing a state where the grip portion is traveling toward a sheet release position.
Figure 13:
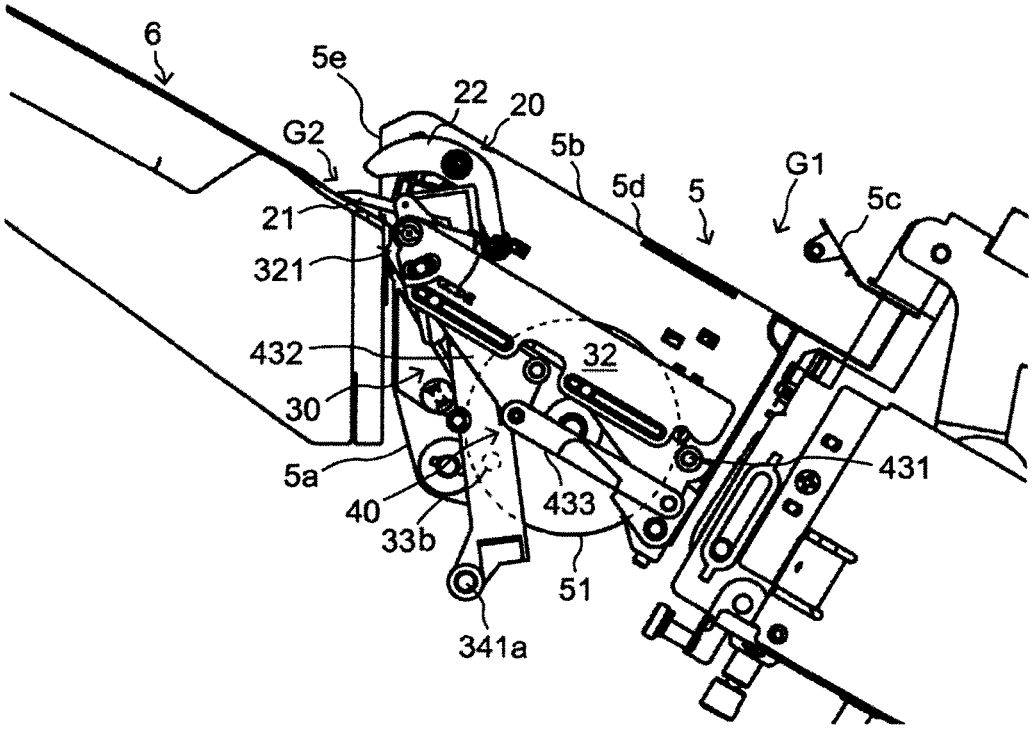
FIG. 13 is a front view of the sheet loading apparatus according to the embodiment of the present invention, showing a state where the grip portion is at the sheet release position.
Figure 14:
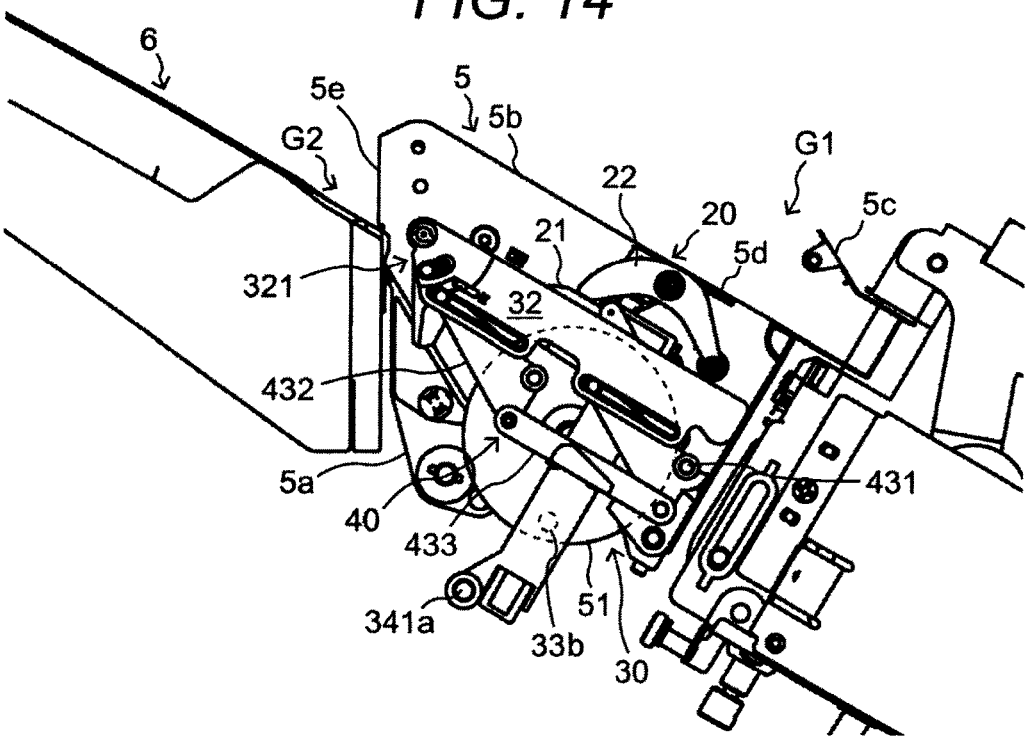
FIG. 14 is a front view of the sheet loading apparatus according to the embodiment of the present invention, showing a state where the grip portion is traveling toward the sheet gripping position.
Figure 15:
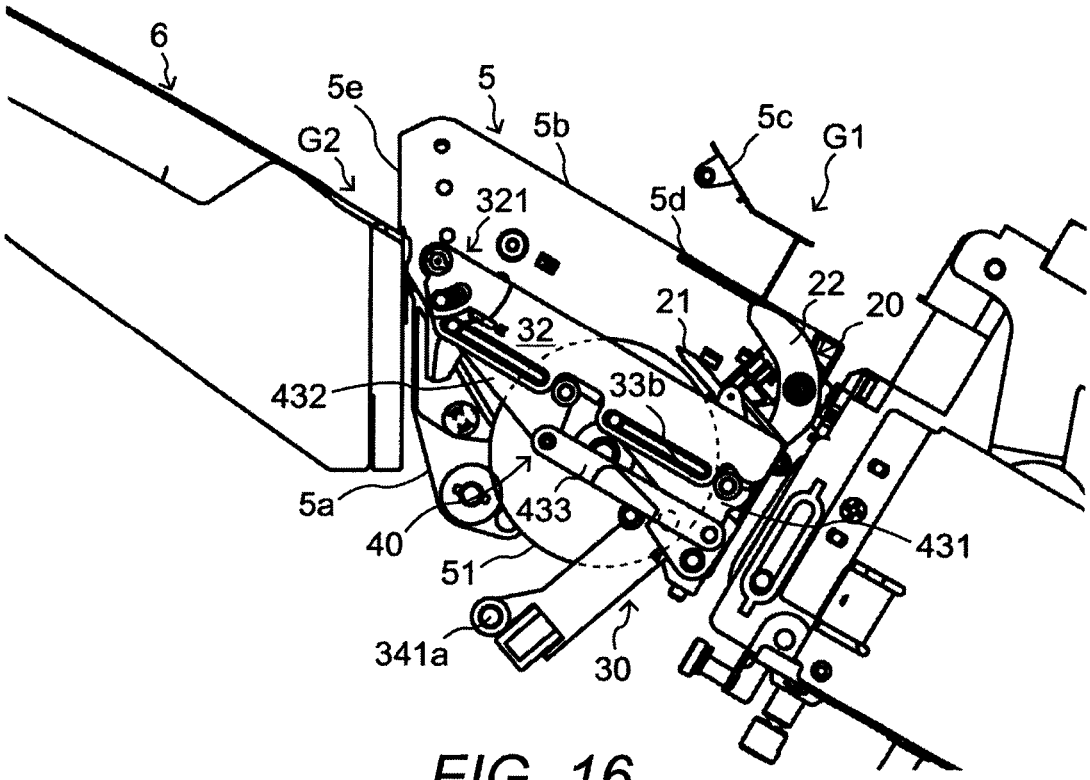
FIG. 15 is a front view of the sheet loading apparatus according to the embodiment of the present invention, showing a state where the grip portion has reached below the sheet gripping position.

Next, the operation of carrying a sheet from the intermediate tray 5 to the output tray 6 of the sheet loading apparatus 1 is schematically described with reference to FIGS. 11 to 15. FIG. 11 is a front view of the sheet loading apparatus 1, showing a state where the grip portion 20 is at the gripping position G1 of the sheet S. FIG. 12 is a front view of the sheet loading apparatus 1, showing a state where the grip portion 20 is traveling toward the release position G2 of the sheet S. FIG. 13 is a front view of the sheet loading apparatus 1, showing a state where the grip portion 20 is at the release position G2 of the sheet S. FIG. 14 is a front view of the sheet loading apparatus 1, showing a state where the grip portion 20 is traveling toward the gripping position G1 of the sheet S. FIG. 15 is a front view of the sheet loading apparatus 1, showing a state where the grip portion 20 has reached below the gripping position G1 of the sheet S.

The detailed configuration of the sheet loading apparatus 1 is based on the description previously given with reference to FIGS. 3 to 10. The reference numerals may be omitted in FIGS. 11 to 15.

The grip portion 20 appears above the sheet loading surface 5*b* of the intermediate tray 5 as shown in FIG. 11 when at the gripping position G1 of the sheet S. At this point in time, the retaining piece 21*c* of the lower grip 21 comes into contact with the retaining plate 5*d* of the intermediate tray 5 from below. The gripping surface 21*a* is not displaced upward of the sheet loading surface 5*b*. Furthermore, the two rollers 31 of the sliding portion 30 align parallel to the sheet loading surface 5*b* along the guide portion 32*a*. Accordingly, the gripping surface 21*a* of the lower grip 21 is parallel to and substantially flush with the sheet loading surface 5*b* of the intermediate tray 5.

On the other hand, the contact portion 22*a* of the upper grip 22 comes into contact with the housing portion 5*a* of the intermediate tray 5. The downstream portion of the upper grip 22 in the sheet feed direction is displaced toward a direction away from the gripping surface 21*a*, that is, upward, against the biasing force of the grip biasing member 23. Consequently, the space between the lower grip 21 and the upper grip 22 of the grip portion 20 is fully extended to be prepared for gripping the sheet S.

Before the grip portion 20 moves to the gripping position G1 of the sheet S, the sheet trailing end member 5*c* of the intermediate tray 5 moves along the sheet feed direction to the gripping position G1 from a withdrawal position (see FIG. 12) for receiving the sheet S falling freely from the first sheet delivery path 3.

Next, when the disc member 51 rotates counterclockwise in FIG. 11, the crank pin 33*b* also rotates counterclockwise. Consequently, the crank arm 34 engaging with the crank pin 33*b* rotates about the axis of the support shaft 341*a*. The grip portion 20 moves downstream in the sheet feed direction. In this manner, the sliding portion 30, which has obtained power from the power transmission portion 50, moves the grip portion 20 downstream in the sheet feed direction from the gripping position G1 of the sheet S.

When the grip portion 20 starts moving downstream in the sheet feed direction, the contact portion 22*a* of the upper grip 22 moves away from the housing portion 5*a* of the intermediate tray 5. Consequently, the biasing force of the grip biasing member 23 acts on the upper grip 22 to bring the downstream portion of the upper grip 22 in the sheet feed direction close to the gripping surface 21*a* of the lower grip 21. As a result, at the gripping position G1, the grip portion 20 can firmly grip the sheet S loaded in the intermediate tray 5 with the lower grip 21 and the upper grip 22.

When the grip portion 20 moves downstream in the sheet feed direction, the cam groove 41*b* also rotates with the rotation of the disc member 51. However, the follower member 42 does not oscillate on the basis of the shape of the cam groove 41*b*, and the link mechanism 43 is not displaced, either. In other words, the engagement pins 431*b* and 432*b* of the first link member 431 and the second link member 432 are not displaced. When the rail member 32 is not displaced in the up-and-down direction, and the sliding portion 30 moves the grip portion 20 downstream in the sheet feed direction in a state where the gripping surface 21*a* stays parallel to the sheet loading surface 5*b* of the intermediate tray 5 between the gripping position G1 and the release position G2 of the sheet S.

Furthermore, when the disc member 51 rotates counterclockwise, the crank arm 34 is displaced with the rotation of the crankpin 33*b*. The grip portion 20 reaches the downstream end in the sheet feed direction above the sheet loading surface 5*b* of the intermediate tray 5 as shown in FIG. 12. At this point in time, the crank arm 34 is in a form where the second arm member 342 is fully extended.

Next, when the disc member 51 rotates counterclockwise, the follower member 42 and the link mechanism 43 are displaced on the basis of the shape of the cam groove 41*b*. The grip portion 20 moves downward as shown in FIG. 13. At this point in time, the lift portion 40, which has obtained power from the power transmission portion 50, moves the grip portion 20 via the sliding portion 30 to conceal the grip portion 20 below the sheet loading surface 5*b* of the intermediate tray 5.

Specifically, the lift portion 40 moves the grip portion 20 downward of the sheet loading surface 5*b* of the intermediate tray 5 and in a direction in which the grip portion 20 is inclined toward the upstream side in the sheet feed direction with respect to the sheet loading surface 5*b* to cause the grip portion 20 to reach the release position G2 of the sheet S. At this point in time, the crank arm 34 is in a form where the second arm member 342 is relatively contracted.

Next, when the disc member 51 rotates counterclockwise, the crank arm 34 is displaced with the rotation of the crank pin 33*b* to cause the grip portion 20 to reach the upstream portion in the sheet feed direction below the sheet loading surface 5*b* of the intermediate tray 5 as shown in FIG. 14.

When the grip portion 20 moves upstream in the sheet feed direction, the cam groove 41*b* also rotates with the rotation of the disc member 51. However, the follower member 42 and the link mechanism 43 are not displaced on the basis of the shape of the cam groove 41*b*. In other words, the rail member 32 is not substantially displaced in the up-and-down direction. The sliding portion 30 moves the grip portion 20 concealed below the sheet loading surface 5*b* of the intermediate tray 5, upstream in the sheet feed direction, parallel to the sheet loading surface 5*b*.

Next, when the disc member 51 rotates counterclockwise, the crank arm 34 is displaced with the rotation of the crank pin 33*b* to cause the grip portion 20 to reach the upstream end in the sheet feed direction below the sheet loading surface 5*b* of the intermediate tray 5 as shown in FIG. 15. At this point in time, as described above, the contact portion 22*a* of the upper grip 22 of the grip portion 20 comes into contact with the housing portion 5*a* to displace upward the downstream portion of the upper grip 22 in the sheet feed direction. Accordingly, the space between the lower grip 21 and the upper grip 22 is fully extended.

When the disc member 51 subsequently rotates counterclockwise, the follower member 42 and the link mechanism 43 are displaced on the basis of the shape of the cam groove 41*b* to move the grip portion 20 upward as shown in FIG. 11. Specifically, the lift portion 40 moves the grip portion 20 to the gripping position G1 of the sheet S above the sheet loading surface 5*b* of the intermediate tray 5 in a direction at a substantially right angle to the sheet loading surface 5*b*.

The sheet loading apparatus 1 achieves one cycle for moving the grip portion 20 from the gripping position G1 to the release position G2 of the sheet S and then back to the gripping position G1 as described above, in the operation of carrying a sheet from the intermediate tray 5 to the output tray 6.

Figure 16:
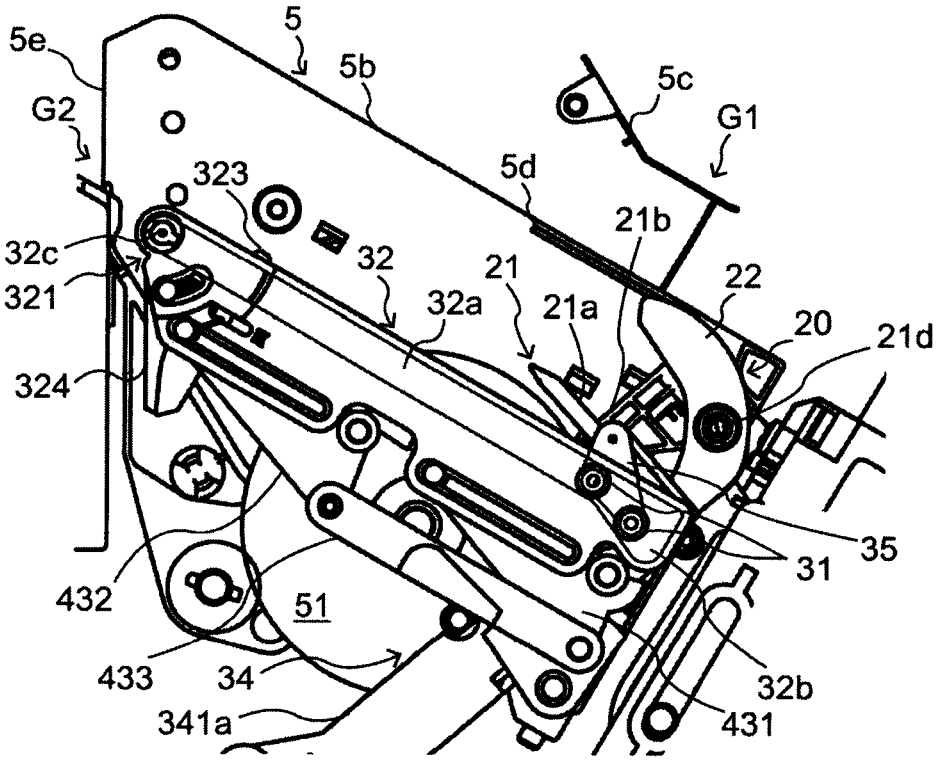
FIG. 16 is an enlarged front view showing a state where the grip portion of the sheet loading apparatus according to the embodiment of the present invention has reached below the sheet gripping position.

Next, the detailed configuration and the operation of the upstream portion of the sheet loading apparatus 1 in the sheet feed direction are described with reference to FIG. 16. FIG. 16 is an enlarged front view showing a state where the grip portion 20 has reached below the gripping position G1 of the sheet S. For convenience of description, in FIG. 16, the guide portion 32*a* and the rollers 31, which are formed or placed on the back side of the rail member 32 in the depth direction of FIG. 16 and cannot be essentially seen from the front side, are indicated by solid lines.

The guide portion 32*a* of the rail member 32 includes the expanded portion 32*b* at its upstream end in the sheet feed direction as shown in FIG. 16. One lower surface of the guide portion 32*a* of a gutter shape in the expanded portion 32*b* is inclined increasingly downward away from the sheet loading surface 5*b* toward the upstream side in the sheet feed direction.

When the grip portion 20 moves from the downstream portion to the upstream portion in the sheet feed direction below the sheet loading surface 5*b* in the operation of carrying a sheet from the intermediate tray 5 to the output tray 6, the two rollers 31 of the guide portion 32*a* reach the expanded portion 32*b*. At this point in time, the weight of the grip portion 20 or the biasing force of the grip biasing member 23 acts in a direction in which the two rollers 31 are caused to follow the one lower surface of the expanded portion 32*b*. As a result, the grip portion 20 is inclined upstream in the sheet feed direction in such a manner that the area, which is gripped by the lower grip 21 and the upper grip 22, to grip the sheet S faces upward.

Figure 17:
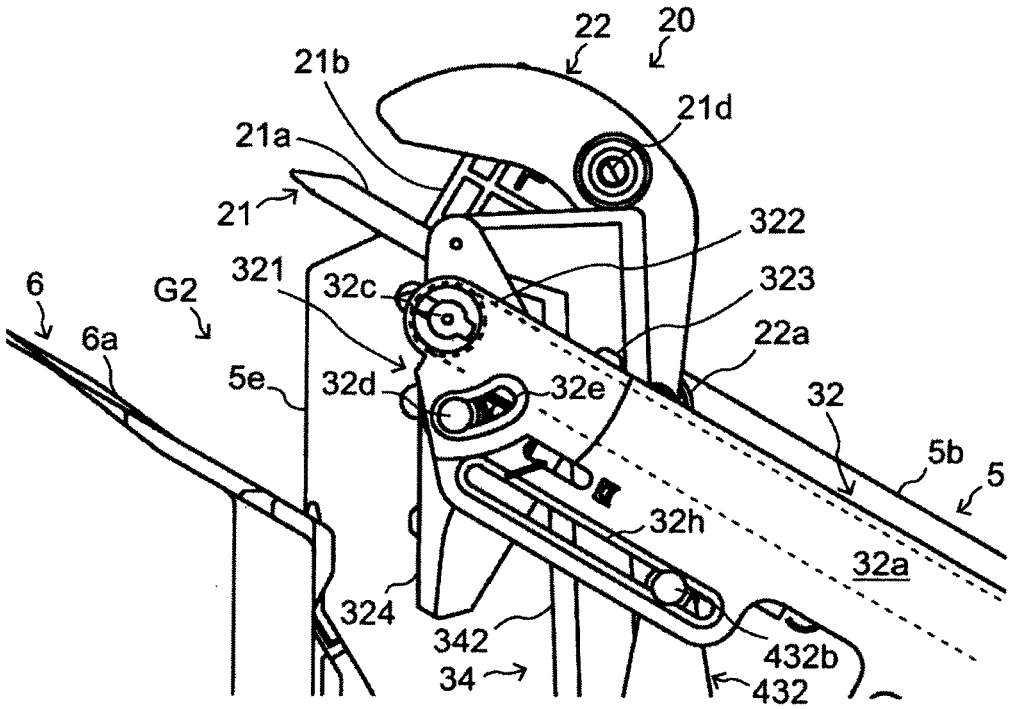
FIG. 17 is an enlarged front view showing a state where the grip portion of the sheet loading apparatus according to the embodiment of the present invention has reached above the sheet release position.
Figure 18:
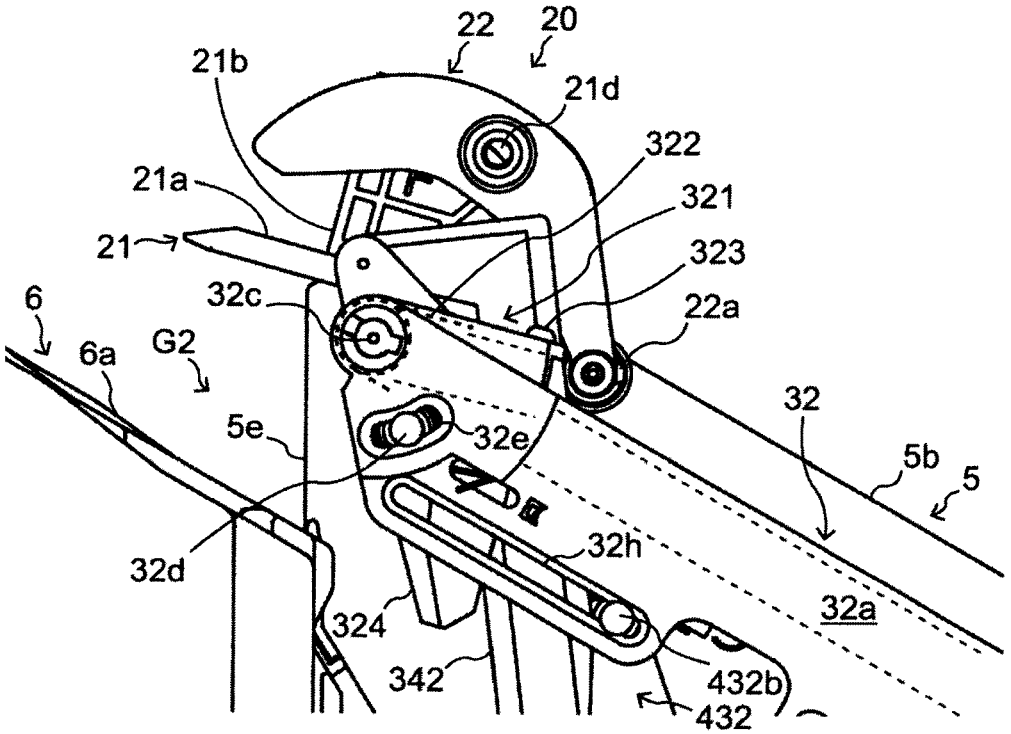
FIG. 18 is an enlarged front view showing a state where the grip portion of the sheet loading apparatus according to the embodiment of the present invention is changing its attitude above the sheet release position.
Figure 19:
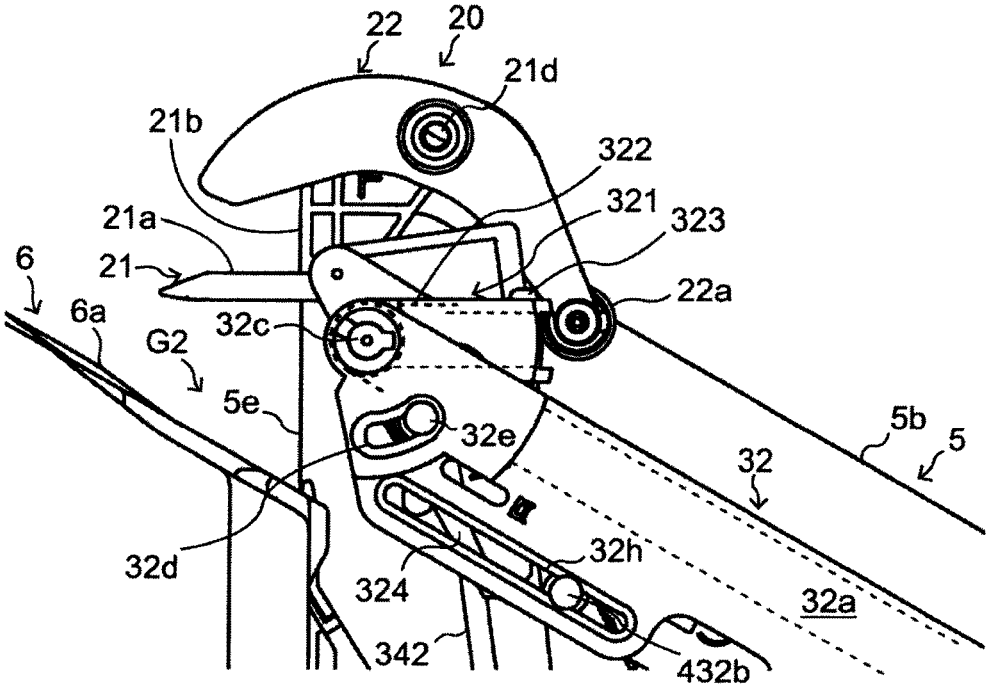
FIG. 19 is an enlarged front view showing a state where the grip portion of the sheet loading apparatus according to the embodiment of the present invention has changed the attitude above the sheet release position.
Figure 20:
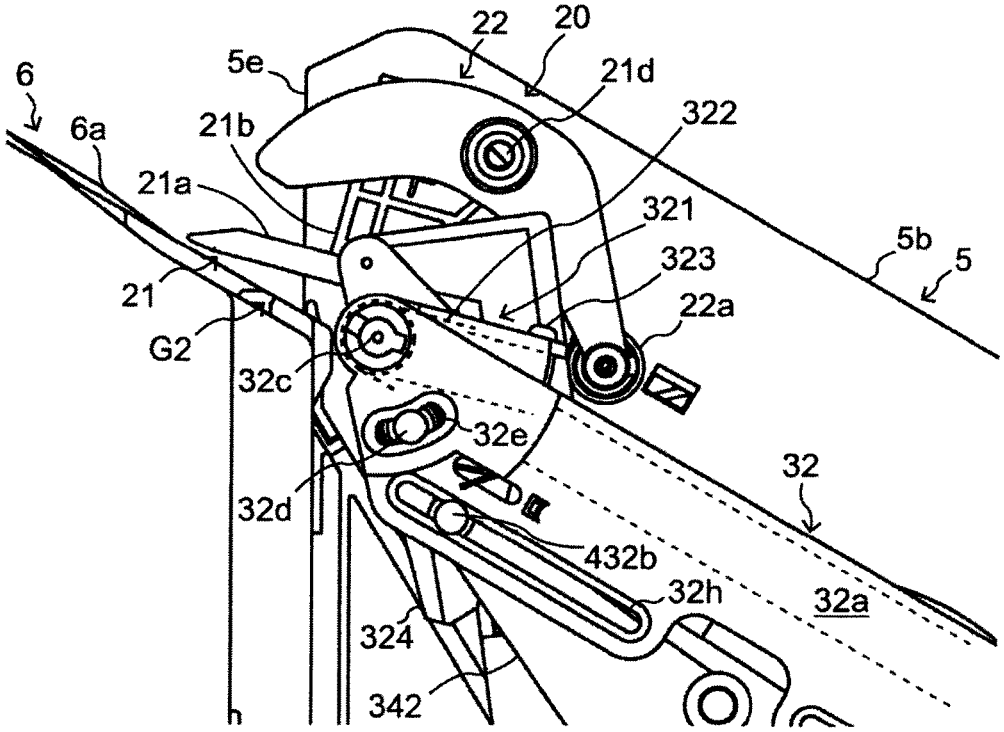
FIG. 20 is an enlarged front view showing a state where the grip portion of the sheet loading apparatus according to the embodiment of the present invention is descending toward the sheet release position.
Figure 21:
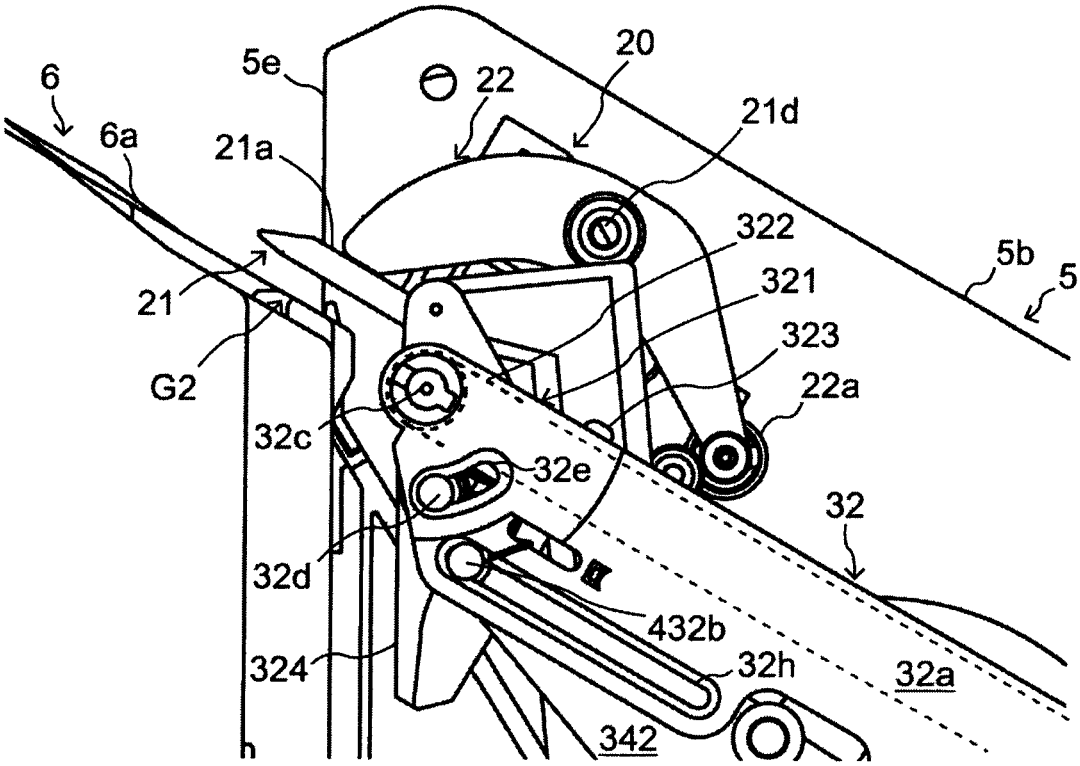
FIG. 21 is an enlarged front view showing a state where the grip portion of the sheet loading apparatus according to the embodiment of the present invention has reached the sheet release position.

Next, the detailed configuration and the operation of the downstream portion of the sheet loading apparatus 1 in the sheet feed direction are described with reference to FIGS. 17 to 21. FIG. 17 is an enlarged front view showing a state where the grip portion 20 has reached above the release position G2 of the sheet S. FIG. 18 is an enlarged front view showing a state where the grip portion 20 is changing its attitude above the release position G2 of the sheet S. FIG. 19 is an enlarged front view showing a state where the grip portion 20 has changed the attitude above the release position G2 of the sheet S. FIG. 20 is an enlarged front view showing a state where the grip portion 20 is descending toward the release position G2 of the sheet S. FIG. 21 is an enlarged front view showing a state where the grip portion 20 has reached the release position G2 of the sheet S.

When the grip portion 20 has reached the downstream end in the sheet feed direction above the sheet loading surface 5*b* of the intermediate tray 5, that is, above the release position G2 of the sheet S, the gripping surface 21*a* of the grip portion 20 becomes parallel to and substantially flush with the sheet loading surface 5*b* as shown in FIG. 17.

At this point in time, the two rollers 31 (see FIG. 5) supported by the grip portion 20 fit into the downstream portion, which is formed in the rotation guide member 321, of the guide portion 32*a* in the sheet feed direction. The rotation stop portion 323 then comes into contact with the unshown housing portion 5*a* of the intermediate tray 5, and prevents the rotation guide member 321 from being rotated and displaced from the attitude parallel to the sheet feed direction against the biasing force of the rotation guide biasing member 322 (see FIG. 7).

Next, when the lift portion 40 moves the grip portion 20 downward via the sliding portion 30, the biasing force of the rotation guide biasing member 322 rotates the rotation guide member 321 in a direction in which its upstream portion in the sheet feed direction comes close to the sheet loading surface 5*b*, that is, counterclockwise about the support shaft 32*c* in FIG. 18. Consequently, the grip portion 20 starts changing its attitude in such a manner that the downstream portion of the grip portion 20 in the sheet feed direction, that is, the area where the lower grip 21 and the upper grip 22 grip the sheet S faces downward.

Furthermore, when the grip portion 20 moves downward, the projection 32*d* of the rotation guide member 321 is restricted by the restriction groove 32*e* of the rail member 32 as shown in FIG. 19 to stop the change of the attitude of the grip portion 20, the change being in step with the rotation of the rotation guide member 321. The attitude of the grip portion 20 shown in FIG. 19 is maintained until the grip portion 20 descends further by a predetermined amount.

The lift portion 40 operates the link mechanism 43 when moving the grip portion 20 downward. At this point in time, the engagement pins 431*b* and 432*b* of the first link member 431 and the second link member 432 of the link mechanism 43 move from the upstream side to the downstream side in the sheet feed direction in the slits 32*g* and 32*h* of the rail member 32 as shown in FIGS. 18, 19, and 20.

When the grip portion 20, which is moving downward, comes close to the release position G2 of the sheet S, the engagement pin 432*b* of the second link member 432, which is moving in the slit 32*h* of the rail member 32, comes into contact with the engagement piece 324 of the rotation guide member 321 as shown in FIG. 20. Consequently, the rotation guide member 321 rotates clockwise about the support shaft 32*c* in FIG. 20 against the biasing force of the rotation guide biasing member 322. The attitude of the grip portion 20 is then returned in such a manner that the gripping surface 21*a* of the grip portion 20 becomes close to parallel to a sheet loading surface 6*a* of the output tray 6.

When the grip portion 20 has reached the release position G2 of the sheet S, the projection 32*d* of the rotation guide member 321 is restricted by the restriction groove 32*e* of the rail member 32 as shown in FIG. 21 to stop the change of the attitude of the grip portion 20, the change being in step with the rotation of the rotation guide member 321. The guide portion 32*a* returns to the form extending straight from the upstream portion to the downstream end in the sheet feed direction. The gripping surface 21*a* of the grip portion 20 becomes substantially parallel to the sheet loading surface 6*a* of the output tray 6.

When the lift portion 40 continues operating, the grip portion 20 moves upstream in the sheet feed direction via the rail member 32 as shown in FIG. 21. Consequently, the upstream end, in the sheet feed direction, of the stack of the sheets S gripped by the grip portion 20 comes into contact with and caught on the wall portion 5*e* at the downstream end of the housing portion 5*a* in the sheet feed direction. As a result, the sheets S are released from the state of being gripped by the grip portion 20.

As in the embodiment, the sheet loading apparatus 1 includes the common power transmission portion 50 that transmits power to both the sliding portion 30 and the lift portion 40. In the downstream portion of the intermediate tray 5 in the sheet feed direction, the lift portion 40 moves the grip portion 20 downward of the sheet loading surface 5*b* of the intermediate tray 5 and in the direction in which the grip portion 20 is inclined toward the upstream side in the sheet feed direction with respect to the sheet loading surface 5*b*, and causes the grip portion 20 to reach the release position G2 of the sheet S.

According to this configuration, if the sheet loading surface 5*b* of the intermediate tray 5 is inclined, rising increasingly toward the downstream side in the sheet feed direction, when the grip portion 20 is moved downward with respect to the sheet loading surface 5*b* of the intermediate tray 5 in the downstream portion of the intermediate tray 5 in the sheet feed direction, the grip portion 20 does not protrude further downstream of the downstream end of the intermediate tray 5 in the sheet feed direction. Moreover, the common power transmission portion 50 is included for both the sliding portion 30 and the lift portion 40. Accordingly, power can be transmitted from the single drive source. Consequently, sheets can be carried in an orderly manner with the configuration obtained by promoting size reduction and cost reduction.

The intermediate tray 5 is configured in such a manner that the sheet loading surface 5*b* is inclined, rising increasingly toward the downstream side in the sheet feed direction. Accordingly, the sheets S loaded in the intermediate tray 5 automatically move upstream in the sheet feed direction by the action of gravity. Consequently, the sheets S can be aligned in an orderly manner on the upstream side in the sheet feed direction in the intermediate tray 5.

The grip portion 20 includes the lower grip 21 that includes the gripping surface 21*a* facing the undersurface of the sheet S to come into contact with the sheet S from below, the upper grip 22 that is rotatably connected to the lower grip 21 via the connecting shaft 21*d* extending in the direction intersecting with the sheet feed direction to come into contact with the sheet S from above, and the grip biasing member 23 that rotates the upper grip 22 about the connecting shaft 21*d* to bias the upper grip 22 in the direction in which the downstream portion of the upper grip 22 in the sheet feed direction comes close to the gripping surface 21*a* of the lower grip 21. Consequently, the sheet S can be easily and firmly gripped.

The sliding portion 30 includes the two rollers 31 that is supported by the grip portion 20 and placed, side by side, in the sheet feed direction, the rail member 32 having the guide portion 32*a* that extends parallel to the sheet loading surface 5*b* of the intermediate tray 5 and engages with the two rollers 31, movably along the sheet feed direction, the crank portion 33 that is provided with the crank shaft 33*a* and the crankpin 33*b*, which extend in the direction intersecting with the sheet feed direction, and can rotate about the crank shaft 33*a* in the plane extending in the sheet feed direction and the up-and-down direction, and the crank arm 34 having the first arm member 341 whose lower end is rotatably supported via the support shaft 341*a* parallel to the crank shaft 33*a*, and the second arm member 342 attached at an upper end to the grip portion 20 to be displaced relatively to the first arm member 341, the second arm member 342 having the groove portion 342*a* that movably engages with the crank pin 33*b*. Consequently, the sliding portion 30 can move the grip portion 20 parallel from the gripping position G1 of the sheet S to the downstream side in the sheet feed direction. Furthermore, the sliding portion 30 can move the grip portion 20 parallel from the release position G2 of the sheet S to the upstream side in the sheet feed direction.

Moreover, the two rollers 31 are placed parallel to the gripping surface 21*a* of the lower grip 21. Accordingly, the two rollers 31 move along the guide portion 32*a* extending parallel to the sheet loading surface 5*b* to allow the grip portion 20 to move in the state where the gripping surface 21*a* stays parallel to the sheet loading surface 5*b*.

Moreover, the guide portion 32*a* includes the expanded portion 32*b* that is provided at the upstream end in the sheet feed direction and expands increasingly toward upstream side in the sheet feed direction in the direction away from the sheet loading surface 5*b* of the intermediate tray 5. According to this configuration, the weight of the grip portion 20 or the biasing force of the grip biasing member 23 acts in the direction in which the two rollers 31 are caused to follow the lower surface of the expanded portion 32*b* when the grip portion 20 moves from the downstream portion to the upstream portion in the sheet feed direction. The grip portion 20 is inclined in such a manner that the area to grip the sheet S faces upward. Consequently, when the grip portion 20 is moved to the gripping position G1 of the sheet S from below the sheet loading surface 5*b*, the grip portion 20 can be moved upstream in the feed direction of the sheet S without coming into contact with the upstream end of the sheet S in the feed direction.

The rail member 32 includes the rotation guide member 321 that is provided to the downstream portion in the sheet feed direction, includes part of the guide portion 32*a*, and is supported at the downstream end rotatably about the support shaft 32*c* extending in the direction intersecting with the sheet feed direction, the rotation guide biasing member 322 that rotates the rotation guide member 321 about the support shaft 32*c* to bias the rotation guide member 321 in the direction in which the upstream portion of the rotation guide member 321 in the sheet feed direction comes close to the sheet loading surface 5*b* of the intermediate tray 5, the rotation stop portion 323 that prevents the rotation guide member 321 from being rotated and displaced from the attitude parallel to the sheet feed direction against the biasing force of the rotation guide biasing member 322 in the state where the rail member 32 is closest to the sheet loading surface 5*b* of the intermediate tray 5, and the engagement piece 324 being the rotation return portion for rotating and displacing the rotation guide member 321 against the biasing force of the rotation guide biasing member 322 to return the rotation guide member 321 to the attitude parallel to the sheet feed direction in the state where the rail member 32 is away from the sheet loading surface 5*b* of the intermediate tray 5 and close to the release position G2 of the sheet S. According to this configuration, the grip portion 20 is inclined by the biasing force of the rotation guide biasing member 322 in such a manner that the area of the grip portion 20 to grip the sheet S faces downward when the grip portion 20 moves to the downstream end of the rail member 32 in the sheet feed direction, and the rail member 32 descends, that is, moves away from the sheet loading surface 5*b* of the intermediate tray 5. Consequently, when the sheets S are loaded in the output tray 6 and the grip of the grip portion 20 is released, the buckling of a stack of the sheets S can be prevented. Furthermore, the attitude of the grip portion 20 is returned to the original attitude at the release position G2 of the sheet S; accordingly, the sheets S can be released maintaining the orderly state.

Moreover, as in the embodiment, the sheet loading apparatus 1 includes the expanded portion 32*b* that increasingly expands the guide portion 32*a*, which is provided at the upstream end of the guide portion 32*a* in the sheet feed direction, toward the upstream side in the sheet feed direction in the direction away from the sheet loading surface 5*b* of the intermediate tray 5.

According to this configuration, the weight of the grip portion 20, or the biasing force of the grip biasing member 23 acts in the direction in which the two rollers 31 are caused to follow the lower surface of the expanded portion 32*b* when the grip portion 20 moves from the downstream portion to the upstream portion in the sheet feed direction. The grip portion 20 is then inclined in such a manner that the area to grip the sheet S faces upward. Consequently, when the grip portion 20 is moved to the gripping position G1 of the sheet S from below the sheet loading surface 5*b*, the grip portion 20 can be moved upstream in the feed direction of the sheet S without coming into contact with the upstream end of the sheet S in the feed direction. A space required to move the grip portion 20 can be reduced as much as possible in the upstream portion of the intermediate tray 5 in the sheet feed direction. Consequently, with the configuration obtained by promoting size reduction, the sheets can be carried in an orderly manner.

The sliding portion 30 includes the crank portion 33 that is provided with the crank shaft 33*a* and the crank pin 33*b*, which extend in the direction intersecting with the sheet feed direction, and can be rotated about the crank shaft 33*a* in the plane extending in the sheet feed direction and the up-and-down direction, and the crank arm 34 having the first arm member 341 whose lower end is rotatably supported via the support shaft 341*a* parallel to the crank shaft 33*a* and the second arm member 342 attached at an upper end to the grip portion 20 to be displaced relatively to the first arm member 341, the second arm member 342 having the groove portion 342*a* that movably engages with the crank pin 33*b*. Consequently, the sliding portion 30 can move the grip portion 20 parallel from the gripping position G1 of the sheet S to the downstream side in the sheet feed direction. Furthermore, the sliding portion 30 can move the grip portion 20 parallel from the release position G2 of the sheet S to the upstream side in the sheet feed direction.

Moreover, the two rollers 31 are placed parallel to the gripping surface 21*a* of the lower grip 21. Accordingly, the two rollers 31 move along the guide portion 32*a* extending parallel to the sheet loading surface 5*b* to allow the grip portion 20 to move in the state where the gripping surface 21*a* stays parallel to the sheet loading surface 5*b*.

The rail member 32 includes the rotation guide member 321 that is provided to the downstream portion in the sheet feed direction, includes part of the guide portion 32*a*, and is supported at the downstream end rotatably about the support shaft 32*c* extending in the direction intersecting with the sheet feed direction, the rotation guide biasing member 322 that rotates the rotation guide member 321 about the support shaft 32*c* to bias the rotation guide member 321 in the direction in which the upstream portion of the rotation guide member 321 in the sheet feed direction comes close to the sheet loading surface 5*b* of the intermediate tray 5, the rotation stop portion 323 that prevents the rotation guide member 321 from being rotated and displaced from the attitude parallel to the sheet feed direction against the biasing force of the rotation guide biasing member 322 in the state where the rail member 32 is closest to the sheet loading surface 5*b* of the intermediate tray 5, and the engagement piece 324 being the rotation return portion for rotating and displacing the rotation guide member 321 against the biasing force of the rotation guide biasing member 322 to return the rotation guide member 321 to the attitude parallel to the sheet feed direction in the state where the rail member 32 is away from the sheet loading surface 5*b* of the intermediate tray 5 and close to the release position G2 of the sheet S. According to this configuration, the grip portion 20 is inclined by the biasing force of the rotation guide biasing member 322 in such a manner that the area of the grip portion 20 to grip the sheet S faces downward when the grip portion 20 moves to the downstream end of the rail member 32 in the sheet feed direction, and the rail member 32 descends, that is, moves away from the sheet loading surface 5*b* of the intermediate tray 5. Consequently, when the sheets S are loaded in the output tray 6 and the grip of the grip portion 20 is released, the buckling of a stack of the sheets S can be prevented. Furthermore, the attitude of the grip portion 20 is returned to the original attitude at the release position G2 of the sheet S; accordingly, the sheets S can be released maintaining the orderly state.

Moreover, as in the embodiment, the rail member 32 of the sheet loading apparatus 1 includes the rotation guide member 321 that is provided to the downstream portion in the sheet feed direction, includes part of the guide portion 32*a*, and is supported at the downstream rotatably about the support shaft 32*c* extending end in the direction intersecting with the sheet feed direction, the rotation guide biasing member 322 that rotates the rotation guide member 321 about the support shaft 32*c* to bias the rotation guide member 321 in the direction in which the upstream portion of the rotation guide member 321 in the sheet feed direction comes close to the sheet loading surface 5*b* of the intermediate tray 5, the rotation stop portion 323 that prevents the rotation guide member 321 from being rotated and displaced from the attitude parallel to the sheet feed direction against the biasing force of the rotation guide biasing member 322 in the state where the rail member 32 is closest to the sheet loading surface 5*b* of the intermediate tray 5, and the engagement piece 324 being the rotation return portion for rotating and displacing the rotation guide member 321 against the biasing force of the rotation guide biasing member 322 to return the rotation guide member 321 to the attitude parallel to the sheet feed direction in the state where the rail member 32 is away from the sheet loading surface 5*b* of the intermediate tray 5 and close to the release position G2 of the sheet S.

According to this configuration, when the grip portion 20 moves to the downstream end of the rail member 32 in the sheet feed direction, and the rail member 32 descends, that is, moves away from the sheet loading surface 5*b* of the intermediate tray 5, the biasing force of the rotation guide biasing member 322 inclines the grip portion 20 in such a manner that the area to grip the sheet S faces downward. Consequently, when the sheets S are loaded in the output tray 6 and the grip of the grip portion 20 is released, the buckling of a stack of the sheets S can be prevented. Furthermore, the attitude of the grip portion 20 is returned to the original attitude at the release position G2 of the sheet S; accordingly, the sheets S can be released maintaining the orderly state.

The sliding portion 30 includes the two rollers 31 that is supported by the grip portion 20 and placed, side by side, in the sheet feed direction, the rail member 32 having the guide portion 32*a* that extends parallel to the sheet loading surface 5*b* of the intermediate tray 5 and engages with the two rollers 31, movably along the sheet feed direction, the crank portion 33 that is provided with the crank shaft 33*a* and the crankpin 33*b*, which extend in the direction intersecting with the sheet feed direction, and can rotate about the crank shaft 33*a* in the plane extending in the sheet feed direction and the up-and-down direction, and the crank arm 34 having the first arm member 341 whose lower end is rotatably supported via the support shaft 341*a* parallel to the crank shaft 33*a*, and the second arm member 342 attached at an upper end to the grip portion 20 to be displaced relatively to the first arm member 341, the second arm member 342 having the groove portion 342*a* that movably engages with the crank pin 33*b*. Consequently, the sliding portion 30 can move the grip portion 20 parallel from the gripping position G1 of the sheet S to the downstream side in the sheet feed direction. Furthermore, the sliding portion 30 can move the grip portion 20 parallel from the release position G2 of the sheet S to the upstream side in the sheet feed direction.

Moreover, the two rollers 31 are placed parallel to the gripping surface 21*a* of the lower grip 21. Accordingly, the two rollers 31 move along the guide portion 32*a* extending parallel to the sheet loading surface 5*b* to allow the grip portion 20 to move in the state where the gripping surface 21*a* stays parallel to the sheet loading surface 5*b*.

Moreover, the guide portion 32*a* includes the expanded portion 32*b* that is provided at the upstream end in the sheet feed direction, and expands increasingly toward the upstream side in the sheet feed direction in the direction away from the sheet loading surface 5*b* of the intermediate tray 5. According to this configuration, the weight of the grip portion 20, or the biasing force of the grip biasing member 23 acts in the direction in which the two rollers 31 are caused to follow the lower surface of the expanded portion 32*b* when the grip portion 20 moves from the downstream portion to the upstream portion in the sheet feed direction. The grip portion 20 is inclined in such a manner that the area to grip the sheet S faces upward. Consequently, when the grip portion 20 is moved to the gripping position G1 of the sheet S from below the sheet loading surface 5*b*, the grip portion 20 can be moved upstream in the feed direction of the sheet S without coming into contact with the upstream end of the sheet S in the feed direction.

The lift portion 40 includes the cam portion 41 that can rotate about the cam shaft 41*a* extending in the direction intersecting with the sheet feed direction in the plane extending in the sheet feed direction and the up-and-down direction, the follower member 42 that can oscillate about the support shaft 42*a* extending parallel to the cam shaft 41*a*, following the shape of the cam groove 41*b* of the cam portion 41, and the link mechanism 43 connected between the sliding portion 30 and the follower member 42 to move the sliding portion 30 in the up-and-down direction in step with the oscillation of the follower member 42. Consequently, the lift portion 40 can move the grip portion 20 downward of the sheet loading surface 5*b* of the intermediate tray 5 and in the direction in which the grip portion 20 is inclined toward the upstream side in the sheet feed direction with respect to the sheet loading surface 5*b*. Furthermore, the lift portion 40 can move the grip portion 20 to the gripping position G1 of the sheet S above the sheet loading surface 5*b* in the direction forming a substantially right angle to the sheet loading surface 5*b*.

The link mechanism 43 includes the first link member 431 and the second link member 432 that are rotatably supported via the support shafts 431*a* and 432*a* that are placed, side by side, in the sheet feed direction of the intermediate tray 5, and are provided at the positions parallel to the sheet feed direction, and extend in the direction intersecting with the sheet feed direction, and the connecting link 433 that connects the first link member 431 and the second link member 432. The oscillation of the follower member 42 is transmitted to the first link member 431. The second link member 432 performs the same operation as the first link member 431 via the connecting link 433. Consequently, the rail member 32 of the sliding portion 30 can be moved in the up-and-down direction while the guide portion 32*a* stays parallel to the sheet feed direction of the intermediate tray 5.

The power transmission portion 50 includes the disc member 51 being the single rotator. The crank portion 33 and the cam portion 41 are formed on the disc member 51. The rotation axis of the disc member 51 agrees with the axes of the crank shaft 33*a* and the cam shaft 41*a*. According to this configuration, the configuration that transmits power from the single drive source to the sliding portion 30 and the lift portion 40 can be easily formed.

Moreover, the sheet loading apparatus 1 includes the post-processing device 8 for the sheet S, which is placed upstream of the gripping position G1 of the sheet S in the sheet feed direction. According to this configuration, post-processing can be executed on a stack of the sheets S aligned in an orderly manner on the upstream side in the sheet feed direction. Therefore, the occurrence of displacement of a post-processing area and processing failure can be prevented.

The present invention can be used in an image forming apparatus such as a copier.

Although the present invention has been described and illustrated in detail, it is clearly understood that the same is by way of illustrated and example only and is not to be taken by way of limitation, the scope of the present invention being interpreted by terms of the appended claims. Various modifications can be added to embody the present invention within the scope that does not depart from the purport of the invention. Moreover, a plurality of embodiments can be carried out in combination.

What is claimed is:

1. A sheet loading apparatus for carrying a sheet loaded in a first tray to a second tray downstream of the first tray in a sheet feed direction, the sheet loading apparatus comprising:

a grip portion configured to grip the sheet loaded in the first tray;

a sliding portion including a crank arm configured to push the grip portion in a direction parallel to a sheet loading surface of the first tray between a sheet gripping position at an upstream end of the first tray in the sheet feed direction and a sheet release position at a downstream end in the sheet feed direction, the crank arm having a support member, the sliding portion including a rail member, the rail member including a guide portion that is arranged in the direction parallel to the sheet loading surface and engages the support member of the crank arm such that the support member moves together with the grip portion in the direction parallel to the sheet loading surface;

a lift portion configured to move the grip portion via the sliding portion and cause the grip portion to emerge from the sheet loading surface of the first tray; and a common power transmission portion configured to transmit power to both the sliding portion and the lift portion, wherein in one cycle during which the grip portion is moved from the gripping position to the release position of a sheet and then back to the gripping position, after the sliding portion moves the grip portion from the gripping position of a sheet to a downstream side in the sheet feed direction, the lift portion moves the grip portion and the rail member downward of the sheet loading surface of the first tray and moves the grip portion in a direction in which the grip portion is inclined toward an upstream side in the sheet feed direction with respect to the sheet loading surface to cause the grip portion to reach the release position of a sheet, and after the sliding portion moves the grip portion concealed below the sheet loading surface of the first tray to the upstream side in the sheet feed direction, the lift portion moves the rail member upward toward the sheet loading surface and moves the grip portion to the gripping position above the sheet loading surface of the first tray in a direction forming a substantially right angle to the sheet loading surface.

2. The sheet loading apparatus according to claim 1, wherein the first tray is configured in such a manner that the sheet loading surface is inclined, rising increasingly toward a downstream side in the sheet feed direction.

3. The sheet loading apparatus according to claim 1, wherein the grip portion includes a lower grip, having a gripping surface facing an undersurface of a sheet, to come into contact with the sheet from below, an upper grip, rotatably connected to the lower grip via a connecting shaft extending in a direction intersecting with the sheet feed direction, to come into contact with the sheet from above, and a grip biasing member configured to rotate the upper grip about the connecting shaft and bias the upper grip in a direction in which a downstream portion of the upper grip in the sheet feed direction comes close to the gripping surface of the lower grip.

4. The sheet loading apparatus according to claim 1, further comprising a sheet post-processing device placed upstream of the sheet gripping position in the sheet feed direction.

5. An image forming apparatus comprising the sheet loading apparatus according to claim 1.

6. A sheet loading apparatus for carrying a sheet loaded in a first tray to a second tray downstream of the first tray in a sheet feed direction, the sheet loading apparatus comprising:

a grip portion configured to grip the sheet loaded in the first tray;

a sliding portion configured to move the grip portion parallel to a sheet loading surface of the first tray between a sheet gripping position at an upstream end of the first tray in the sheet feed direction and a sheet release position at a downstream end in the sheet feed direction;

a lift portion configured to move the grip portion via the sliding portion and cause the grip portion to emerge from the sheet loading surface of the first tray; and a common power transmission portion configured to transmit power to both the sliding portion and the lift portion, wherein in one cycle during which the grip portion is moved from the gripping position to the release position of a sheet and then back to the gripping position, after the sliding portion moves the grip portion from the gripping position of a sheet to a downstream side in the sheet feed direction, the lift portion moves the grip portion downward of the sheet loading surface of the first tray and in a direction in which the grip portion is inclined toward an upstream side in the sheet feed direction with respect to the sheet loading surface to cause the grip portion to reach the release position of a sheet, and after the sliding portion moves the grip portion concealed below the sheet loading surface of the first tray to the upstream side in the sheet feed direction, the lift portion moves the grip portion to the gripping position above the sheet loading surface of the first tray in a direction forming a substantially right angle to the sheet loading surface, wherein the sliding portion includes a plurality of engagement members supported by the grip portion and placed, side by side, in the sheet feed direction, a rail member having a guide portion extending parallel to the sheet loading surface of the first tray to movably engage with the plurality of engagement members along the sheet feed direction, a crank portion, having a crank shaft extending in the direction intersecting with the sheet feed direction and a crank pin extending away from and parallel to the crank shaft, to be rotatable about the crank shaft in a plane extending in the sheet feed direction and an up-and-down direction, and a crank arm having a first arm member whose lower end is rotatably supported via a support shaft parallel to the crank shaft and a second arm member attached at an upper end to the grip portion to be displaced relatively to the first arm member, the second arm member having a groove portion movably engaging with the crank pin.

7. The sheet loading apparatus according to claim 6, wherein the plurality of engagement members is placed parallel to a gripping surface on the lower grip, the gripping surface facing an undersurface of the sheet.

8. The sheet loading apparatus according to claim 6, wherein the guide portion includes an expanded portion in an upstream end in the sheet feed direction, the expanded portion increasingly expanding the guide portion toward the upstream side in the sheet feed direction in a direction away from the sheet loading surface of the first tray.

9. The sheet loading apparatus according to claim 6, wherein the rail member includes a rotation guide member in a downstream portion in the sheet feed direction, including part of the guide portion and being supported at a downstream end rotatably about a support shaft extending in a direction intersecting with the sheet feed direction, a rotation guide biasing member configured to rotate the rotation guide member about the support shaft and bias the rotation guide member in a direction in which an upstream portion of the rotation guide member in the sheet feed direction comes close to the sheet loading surface of the first tray, a rotation stop portion configured to prevent the rotation guide member from being rotated and displaced from an attitude parallel to the sheet feed direction against biasing force of the rotation guide biasing member in a state where the rail member is closest to the sheet loading surface of the first tray, and a rotation return portion configured to rotate and displace the rotation guide member against the biasing force of the rotation guide biasing member to return the rotation guide member to the attitude parallel to the sheet feed direction in a state where the rail member is away from the sheet loading surface of the first tray and is close to the sheet release position.

10. The sheet loading apparatus according to claim 6, wherein the power transmission portion includes a single rotator, the rotator has the crank portion and the cam portion, and a rotation axis of the rotator agrees with axes of the crank shaft and the cam shaft.

11. A sheet loading apparatus for carrying a sheet loaded in a first tray to a second tray downstream of the first tray in a sheet feed direction, the sheet loading apparatus comprising:

a grip portion configured to grip the sheet loaded in the first tray;

a sliding portion configured to move the grip portion parallel to a sheet loading surface of the first tray between a sheet gripping position at an upstream end of the first tray in the sheet feed direction and a sheet release position at a downstream end in the sheet feed direction;

a lift portion configured to move the grip portion via the sliding portion and cause the grip portion to emerge from the sheet loading surface of the first tray; and a common power transmission portion configured to transmit power to both the sliding portion and the lift portion, wherein in one cycle during which the grip portion is moved from the gripping position to the release position of a sheet and then back to the gripping position, after the sliding portion moves the grip portion from the gripping position of a sheet to a downstream side in the sheet feed direction, the lift portion moves the grip portion downward of the sheet loading surface of the first tray and in a direction in which the grip portion is inclined toward an upstream side in the sheet feed direction with respect to the sheet loading surface to cause the grip portion to reach the release position of a sheet, and after the sliding portion moves the grip portion concealed below the sheet loading surface of the first tray to the upstream side in the sheet feed direction, the lift portion moves the grip portion to the gripping position above the sheet loading surface of the first tray in a direction forming a substantially right angle to the sheet loading surface, wherein the lift portion includes a cam portion configured to be rotatable about a cam shaft extending in a direction intersecting with the sheet feed direction in a plane extending in the sheet feed direction and an up-and-down direction, a follower member configured to be able to oscillate about a support shaft extending parallel to the cam shaft, following the cam shape of the cam portion, and a link mechanism connected between the sliding portion and the follower member to move the sliding portion in the up-and-down direction in step with the oscillation of the follower member.

12. The sheet loading apparatus according to claim 11, wherein the link mechanism includes a first and a second link member placed, side by side, in the sheet feed direction of the first tray, the first and the second link member being rotatably supported via support shafts at positions parallel to the sheet feed direction, the support shafts extending in the direction intersecting with the sheet feed direction, and a connecting link connecting the first link member and the second link member, and the oscillation of the follower member is transmitted to the first link member to allow the second link member to perform the same operation as the first link member via the connecting link.

* * * * *